US007387403B2

(12) United States Patent
Mighetto

(10) Patent No.: US 7,387,403 B2
(45) Date of Patent: Jun. 17, 2008

(54) MODULAR LIGHTING APPARATUS

(75) Inventor: Paul R. Mighetto, 1633 La Loma Ave., Berkeley, CA (US) 94709

(73) Assignee: Paul R. Mighetto, Berkeley, CA (US)

( * ) Notice: Subject to any disclaimer, the term of this patent is extended or adjusted under 35 U.S.C. 154(b) by 19 days.

(21) Appl. No.: 11/299,094

(22) Filed: Dec. 8, 2005

(65) Prior Publication Data

US 2006/0126338 A1 Jun. 15, 2006

Related U.S. Application Data

(63) Continuation-in-part of application No. 11/009,576, filed on Dec. 10, 2004, now abandoned.

(51) Int. Cl.
*F21V 29/00* (2006.01)

(52) U.S. Cl. ..... 362/218; 362/221; 362/373; 362/800

(58) Field of Classification Search ..... 362/294, 362/249, 373, 432, 225, 218, 221, 574, 547, 362/548, 549, 545, 540, 29, 30, 632–634, 362/276

See application file for complete search history.

(56) References Cited

U.S. PATENT DOCUMENTS

| | | | | |
|---|---|---|---|---|
| 3,351,751 | A | 11/1967 | Stube et al. | |
| 4,325,052 | A | 4/1982 | Koerner | |
| 5,111,367 | A | 5/1992 | Churchill | |
| 5,392,204 | A | 2/1995 | Schumaker | |
| 5,688,042 | A | 11/1997 | Madadi et al. | |
| 5,785,418 | A | 7/1998 | Hochstein | |
| 5,806,965 | A * | 9/1998 | Deese | 362/249 |
| 6,191,541 | B1 | 2/2001 | Patel et al. | |
| 6,345,902 | B2 | 2/2002 | Ohkohdo et al. | |
| 6,428,189 | B1 | 8/2002 | Hochstein | |
| 6,715,900 | B2 * | 4/2004 | Zhang | 362/294 |

(Continued)

FOREIGN PATENT DOCUMENTS

| | | |
|---|---|---|
| WO | 00/69000 | 11/2000 |

OTHER PUBLICATIONS

International Search Report, mailed Jan. 3, 2007, from related International Application No. PCT/US05/44576, 6 pp , including Notification of Transmittal (BRL1P001X1.WO).

(Continued)

*Primary Examiner*—Y Quach Lee
*Assistant Examiner*—Leah S. Lovell
(74) *Attorney, Agent, or Firm*—Weaver Austin Villeneuve & Sampson LLP

(57) ABSTRACT

Devices for providing light and methods and devices for fabricating them are described. Lighting devices having lighting elements (e.g., based on LEDs, OLEDs, or other lighting technology) coupled to a frame allow for efficient dissipation of heat generated by the lighting elements. Each lighting device can be configured to be easily expandable, replaceable, and adaptable to different lighting device systems. A modular lighting device is also described. According to various embodiments, modular stacked frames and/or modular lighting element subassemblies are used. A manufacturing assembly is also described for fabricating the lighting devices. The use of reclaimed materials in the present invention is also described, which may further add value to the apparatus and methods of the present invention.

20 Claims, 16 Drawing Sheets

U.S. PATENT DOCUMENTS

| | | | | |
|---|---|---|---|---|
| 6,739,735 | B2 * | 5/2004 | Talamo et al. | 362/249 |
| 6,785,991 | B2 | 9/2004 | Colip | |
| 6,796,698 | B2 * | 9/2004 | Sommers et al. | 362/555 |
| 6,815,724 | B2 * | 11/2004 | Dry | 257/88 |
| 6,848,819 | B1 * | 2/2005 | Arndt et al. | 362/545 |
| 6,942,360 | B2 * | 9/2005 | Chou et al. | 362/238 |
| 6,965,205 | B2 | 11/2005 | Piepgras et al. | |
| 6,991,351 | B1 * | 1/2006 | Petrick | 362/373 |
| 7,086,767 | B2 * | 8/2006 | Sidwell et al. | 362/545 |
| 2002/0021573 | A1 | 2/2002 | Zhang | |
| 2003/0156416 | A1 * | 8/2003 | Stopa et al. | 362/294 |
| 2004/0120156 | A1 | 6/2004 | Ryan | |
| 2005/0152146 | A1 * | 7/2005 | Owen et al. | 362/294 |
| 2006/0109661 | A1 * | 5/2006 | Coushaine et al. | 362/373 |

OTHER PUBLICATIONS

Written Opinion of the International Searching Authority, mailed Jan. 3, 2007, from related International Application No. PCT/US05/44576, 6 pp , (BRL1P001X1.WO).

US Office Action mailed May 5, 2006, from U.S. Appl. No. 11/009,576.

US Office Action mailed Oct. 17, 2006, from U.S. Appl. No. 11/009,576.

US Office Action mailed Apr. 9, 2007, from U.S. Appl. No. 11/009,576.

LuxDrive by LEDynamics, Inc., 4020 lo Moon, High-Power LED Light Module, Document COM-DRV-0420-00, Nov. 2004, Rev. 1.0 www.LexDrive.com, no date.

LuxDrive by LEDynamics, DimeDrive, 2-Cell Led Drive Module No. 03030, http://www/leddynamics.com/LuxDrive/content/Page_dime.html, Nov. 29, 2004.

2002-2004 LED Supply, LED Lantern, http://ledsupply.com/ledlantern.html, Dec. 10, 2004.

Advance Transformer Co., Xitanium, LED Drivers, Outdoor Drivers for Luxeon LEDs, Form No. LE-6010-AB-ROI, PDA602801 revised Mar. 2002 www.advancetransformer.com/xitanium.

LUMILEDS Lighting U.S., LLC, SuperFlux LEDs, Technical Datasheet DS05, Nov. 2004.

LuxDrive, 2004 LEDdynamics, Inc. 2009 Micro Puck, Application Note COM-DRV-2009-APP, "Additional Applications of the 2009", no date.

LUMILEDS, Future Electronics, Luxeon Starter Kits, Nov. 19, 2004 http://www.futureelectronics.com/promos/Lumileds/starterkit.asp.

The LED Light.com, AC LED Lighting, 120vac LED Products: LED Medium Base Bulbs—LED Floodlight Bulbs, LED Spotlight Fixtures, LED Interior and Exterior Fixtures—LED Billboard Lights—LED Street Lights—LED Bricks, Nov. 19, 2004 http://www.theledlight.com/120-VAC-LEDbulbs.html.

Welcome to eStar Lighting, 2 page document entitled "Locomotive LED Bulbs" http://www.estarlighting.com/estar.prod/specialty.html, no date.

Welcome to eStar Lighting, 3 page document entitled "Decorative LED Bulbs" http://www.estarlighting.como/estar.prod/arch_decor.html, no date.

Enlighten Magazine, Summer 2004 http://www.permlight.com/literature/enlighten/enlighten2004summer.pdf.

The LED Light.com, 5 page document entitled "The LEDLight.Com Product Index" http://www.theledlight.com/index.html, no date.

LEDTronics, Inc. The Future of Light, 3 page document entitled entitled "R30 Edison Base Indoor/Outdoor Floodlight LED Bulb" http://www.ledtronics.com/ds/r30-123/, no date.

Wavicle, Ltd.—Product Information, 2 page document entitled "New—OptiLED Designer Dimmable" http://cnb-host1.clickandbuild.com/cnb/shop/wavicle?productID=72 &op=catalogue-product_info-null&prodCategoryID=19, no date.

Wavicle Ltd.—The UK online centre for LED lights, bulbs, torches, lanterns, headlamps & gadgets, 3 page document entitled "About Wavicle" http://www.wavicle.biz/about.html, no date.

MoonCell, Incorporated, Tri-Lum, 2 page document entitled "Econo-Lum Specifications May 23, 2004" http://www.mooncell.com/tech_docs/spec_sheet_econo_lum_rev_05_23_04.pdf.

Garrett Wade, Home & Living, Gadgets, 2 page document entitled "Laptop Computer 4-led Lamp" http://www.garrettwade.com/jump/jsp?lGen=detail&itemID=106921&itemType=Product &iMainCat=10107&iSubCat=10111&iProductID=106921, no date.

The LEDLight.com, 9 page document entitled "AC LED Lighting" http://www.theledlight.com/120-VAC-LEDbulbs.html, no date.

* cited by examiner

MODULAR LIGHTING APPARATUS

CROSS-REFERENCE TO RELATED APPLICATIONS

This application is a continuation-in-part of U.S. patent application Ser. No. 11/009,576 filed on Dec. 10, 2004 now abandoned, entitled "APPARATUS FOR PROVIDING LIGHT," which is hereby incorporated by reference.

BACKGROUND OF THE INVENTION

1. Field of the Invention

The present invention relates to lighting. More specifically, the present invention relates to devices for providing light and methods and apparatus for fabricating them.

2. Description of the Prior Art

Conventional lighting devices encompass many types. One type is the incandescent light bulb, which is low cost but very inefficient. It generates between 16 lumens per watt for a tungsten bulb to 22 lumens per watt for a halogen bulb. A second type is the fluorescent tube, which is more efficient. It generates between 50-100 lumens per watt, allowing large energy savings. However, the fluorescent tube is bulky and fragile. Furthermore, it requires a starter circuit.

A third type is the light emitting diode (LED). LEDs are generally robust and moderately efficient with up to 32 lumens per watt. As LED technology advances, brighter and more efficient LEDs are being developed. Although LEDs are good sources of light, they can generate a considerable amount of heat. The heat can be damaging to the performance of the LEDs (e.g., shorter lifespan).

Therefore, it would be desirable to provide improved techniques and mechanisms for providing light based on LEDs while controlling the heat generated from the LEDs.

SUMMARY OF THE INVENTION

Apparatus for providing light and methods and apparatus for fabricating them are provided in the present invention. The use of reclaimed materials in the present invention is also provided, which may add further value to the apparatus and methods of the present invention.

In one aspect of the present invention, a lighting device is provided. The lighting device includes at least one modular subassembly, a metal frame, and electrical circuitry. The at least one modular subassembly has a plurality of lighting elements (e.g., LEDs, OLEDs, etc.). The metal frame is configured to receive the at least one modular subassembly. The metal frame is further configured to conduct heat from the plurality of lighting elements. The electrical circuitry is configured to provide electricity to the plurality of lighting elements.

In some cases, the modular subassembly includes mounting holes for attaching the modular subassembly to the metal frame. In other cases, the modular subassembly includes snug points for attaching the modular subassembly to the metal frame. The metal frame may include a plurality of frame components. According to some embodiments, the plurality of frame components includes modular stacked frames. The metal frame can be constructed from sheet metal. The lighting device may further include a smart strip configured to implement smart features with the lighting device.

In another aspect of the present invention, a manufacturing assembly for fabricating a lighting device is provided. The manufacturing assembly includes an angle gauge configured to receive a pipe and a tube configured to receive the angle gauge and the pipe. The tube may be, e.g., a square tube.

According to various embodiments, the manufacturing assembly further includes a first set of holes through the tube. The first set of holes is configured to receive screws to apply pressure to the angle gauge such that the angle gauge secures the pipe from moving. The manufacturing assembly can further include a second set of holes through the tube and the angle gauge. The second set of holes is configured to receive a drill bit such that corresponding holes can be drilled into the pipe.

In yet another aspect of the present invention, a method of fabricating the lighting device is provided. The method includes (1) providing at least one modular subassembly having a plurality of light emitting diodes (LEDs); (2) providing a metal frame configured for receiving the at least one modular subassembly and for conducting heat from the plurality of LEDs; (3) attaching the at least one modular subassembly to the metal frame; and (4) electrically connecting the plurality of LEDs to a plurality of electrical contacts.

These and other features and advantages of the present invention will be presented in more detail in the following specification of the invention and the accompanying figures, which illustrate by way of example the principles of the invention.

BRIEF DESCRIPTION OF THE DRAWINGS

The invention may best be understood by reference to the following description taken in conjunction with the accompanying drawings, which illustrate specific embodiments of the present invention.

DETAILED DESCRIPTION OF SPECIFIC EMBODIMENTS

Reference will now be made in detail to some specific embodiments of the invention including the best modes contemplated by the inventor for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

Devices for providing light and methods and apparatus for fabricating them are described. Lighting devices based on light emitting diodes (LEDs) coupled to a frame allow for efficient dissipation of heat generated by the LEDs. Each lighting device can be configured to be easily expandable, replaceable, and adaptable to different lighting device systems. The use of reclaimed materials in the present invention is also described, which may further add value to the apparatus and methods of the present invention. It should be noted that the techniques and mechanisms of the present invention are not exclusively used with only LEDs. OLEDs (organic LEDs) and other technology can arise which can employ the techniques and mechanisms of the present invention. For example, the heat dissipation techniques and mechanisms of the present invention can be employed whenever heat management is sought.

Figure 1:
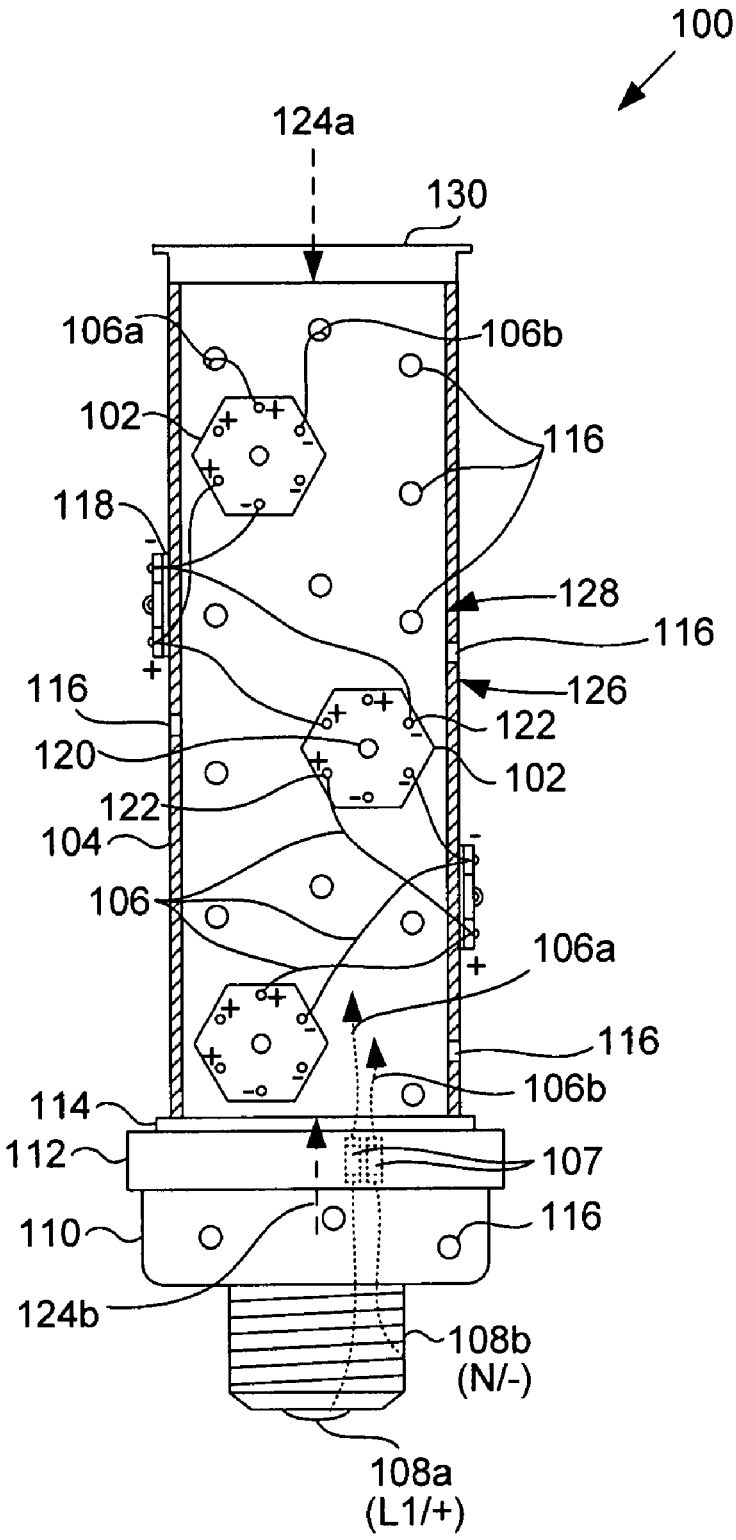
FIG. 1 is a diagrammatic representation of a lighting device according to various embodiments of the present invention.

To begin, FIG. 1 is a diagrammatic representation of a lighting device 100 according to a first embodiment of the present invention. Lighting device 100 is based on using multiple lighting elements. For example, lighting elements may include LEDs 102, OLEDs, or other technology. LEDs 102 may either operate on alternating current (AC) or direct current (DC). For example, LEDs 102 may operate on 120 Volt AC or between 7.8 to 24.6 Volts DC. LEDs may have any power rating (measured in Watts). Typically, the brightness (measured in Lumens) of a LED correlates with the LED's power rating. Therefore, a 5-Watt LED will be generally brighter than a 3-Watt LED, which in turn is generally brighter than a 1-Watt LED.

Many LEDs 102 provide light in a substantially directional manner. Further, LEDs 102 are often configured for longer life spans than other conventional lighting mechanisms (e.g., incandescent light bulb). LEDs 102 can have a life span between 1000-100,000 hours. Since LEDs 102 may last at least ten times longer than a conventional light source, the cost of replacing the light source can be significantly reduced. As indicated earlier, LEDs 102 are more energy efficient than incandescent light sources while approaching the efficiency of fluorescents. Unlike most fluorescent light sources, LEDs 102 generally contain no mercury and have cold start capabilities (e.g., having no ignition problems in cold environments such as down to −40° C.).

Each one of the LEDs 102 may include a LED lens 120 and multiple connection points 122 for forming electrical connections. Connection points 122 may be used to connect a LED to various components (e.g., with another LED) of lighting device 100 via electrical circuitry (e.g., interconnects 106, such as copper wiring). LED lens 120 may be chosen based on the degree of light diffusion, protection of the LED, and/or coloration sought for the application. Connection points 122 are interconnected such that electricity can be delivered to power the LED. For example, connection points 122 may be divided into polarities (e.g., "+" and "−") for DC voltage and voltage potentials (e.g., ("L1": line) and ("N": neutral)) for AC voltage. Additionally, the connection points 122 may be interconnected together based on their common polarities or voltage potentials.

As shown in FIG. 1, LEDs 102 are coupled to a frame 104. Frame 104 is configured to support LEDs 102 and further configured to conduct heat away from them. Accordingly, frame 104 should be made from a heat conducting material, such as metal. In some cases, frame 104 is configured to conduct heat from LEDs 102 such that a maximum temperature of lighting device 100 does not exceed 250° F. Generally, frame 104 can be further configured to receive LEDs 102 such that at least two of the LEDs 102 are facing in different directions away from frame 104.

Frame 104 can be any size or shape. For example, frame 104 may be flat, honeycomb shaped, square shaped, triangle shaped, polygon shaped, etc. For instance, frame 104 can be a pipe having a gauge thickness suitable for the application. The pipe may have two opposite end openings 124*a* and 124*b* with a cylindrical cross-section. A cap 130 may be configured to cover the end openings (e.g., 124*a*). Cap 130 can be made from any suitable material, such as plastic or even metal. LEDs 102 can also be mounted onto cap 130. Preferably, the pipe has an outer surface 126 configured to receive LEDs 102 and maximize heat transfer between LEDs 102 and the pipe. In some cases, the pipe may have outer surfaces 126 (e.g., flat) that match the attaching surfaces (e.g., flat) of LEDs 102. Furthermore, outer surfaces 126 around LEDs 102 can be shaped or coated to reflect the light or absorb heat from LEDs 102. Surface 126 could also have a heat absorbing material/color, e.g. painted black. In sum, the frame's material, thickness, and its shape should be selected to provide adequate support as well as thermal dissipation capabilities to the LEDs.

In order to increase the thermal dissipation capabilities provided by frame 104, ventilation holes 116 may be included in frame 104. Ventilation holes 116 penetrate frame 104 from outer surface 126 to inner surface 128. Ventilation holes 116 may be of any size and number in quantity. In some cases, ventilation holes 116 are large enough to thread interconnects 106 through them. As such, portions of interconnects 106 may be hidden from view by weaving through ventilation holes 116. Therefore, ventilation holes 116 may provide further heat dissipation capabilities as well as support structures for interconnects 106.

Any mechanism or technique may be used to couple LEDs 102 to frame 104. For example, as discussed below in reference to FIGS. 7A and 7B, a lighting element mounting system may be used. For another example, a thermal interface material 118 may be used for attaching LEDs 102 to frame 104. Thermal interface material 118 can allow heat from the LEDs to transfer to the frame. Thermal interface material 118 may include, but is not limited to, solder, epoxy, and double sided heat sink adhesive tape. Solder may have a melting temperature in the range of 450° F. to 600° F. Solder may be composed of 4% silver and 96% tin (no lead). It should be noted that thermal interface material is optional (e.g., where the LED can dissipate heat to the frame directly). Mechanical coupling mechanisms (e.g., screws, flips, clamps, etc.) for electrically connecting the circuit to and from the LEDs can also used instead of solder This is advantageous in cases where LEDs get so hot that the solder may melt.

In general, thermal interface material 118 should possess adequate adhesive properties to support LEDs 102 to frame 104. Preferably, thermal interface material 118 should also possess superior heat conducting properties. That is, the amount of heat transfer between LEDs 102 and frame 104 should be maximized by thermal interface material 118. Generally, the selected thermal interface material 118 (as well as the selected material for frame 104) can depend on maximizing the amount of heat dissipation from the LEDs in order for the LEDs to operate normally and maximize their lifespan. Additionally, thermal interface material 118 should be able to withstand the heat conducted from the LEDs without substantially losing its coupling and heat transfer capabilities.

Lighting device 100 may also include a chassis 110 configured to receive frame 104. Chassis 110 may resemble a conventional base of an incandescent light bulb. Chassis 110 may include a plurality of electrical contacts 108*a* and 108*b* for connecting a power supply to the electrical circuitry of lighting device 100. The electrical contacts may be screw type contacts. That is, screw type contacts require mechanical coupling (e.g., screwing) to form the electrical connections. Typically, chassis 110 contains a cavity that may be used to route interconnects 106 to/from electrical contacts 108*a* and 108*b*. For instance, one interconnect may be used to connect to electrical contact 108*a* (e.g., used for L1 or "+" polarity) and another interconnect used to connect to electrical contact 108*b* (e.g., used for N or "–" polarity). Similar to frame 104, ventilation holes 116 may also be integrated into chassis 110.

In order to secure frame 104 to chassis 110, any suitable mechanism or technique may be used. For example, an inner washer 114 may be used. Inner washer 114 is configured to hold in place a portion of frame 104 within chassis 110. Likewise, in order to secure chassis 110 to inner washer 114, an outer washer 112 may be used. Outer washer 112 is configured to hold in place a portion of chassis 110 with inner washer 114. Inner washer 114 and outer washer 112 may be made from rubber or any other suitable material. Inner washer 114 and outer washer 112 can be of any shape suitable for the application. For example, a circular washer may be used for a pipe with a circular cross section. The selection of inner washer 114 and outer washer 112 may be based on how tight of a connection is sought between chassis 110 and frame 104. For example, inner washer 114 and outer washer 112 may be selected to facilitate a connection that may be easily separable for maintenance purposes, such as when accessing interconnects 106 within chassis 110/frame 104.

In general, lighting device 100 includes electrical circuitry for providing electricity to LEDs 102 and any other electrical component of lighting device 100. Electrical circuitry may include interconnects 106 and various connectors 107 (including circuit protection devices; splice kits; heat shrink tubes, etc.).

Interconnects 106 are generally used to electrically connect together various components of lighting device 100. For example, interconnects 106 may be used to connect LEDs 102 in any electrical circuit formation. In some cases, interconnects 106 are used to connect a portion of LEDs 102 in parallel. In other cases, interconnects 106 are used to connect a portion of LEDs 102 in series. Yet, in other cases, interconnects are used to connect LEDs 102 in both parallel and series formation (e.g., 2×4: (2) branches connected in parallel, where each branch has (4) LEDs connected in series, 2×5, 3×4, 3×5, etc). Referring to FIG. 1, interconnects 106*a* and 106*b* are shown interconnecting electrical contacts 108*a* and 108*b* to LEDs 102 where LEDs 102 are further connected in parallel with interconnects 106.

Connectors 107 may be inserted at any suitable portion of the electrical circuit of lighting device 100. In some cases, connectors 107 are inserted to allow easy separation of portions of lighting device 100. For example, as shown in FIG. 1, connectors 107 located approximately where frame 104 and chassis 110 are connected can facilitate both frame 104 and chassis 110 to be completely decoupled from each other. For another example, connectors 107 may be located between interconnected LEDs such that various LEDs may be easily separated from one another. Connectors 107 may also provide circuit protection capabilities, such as with a fuse or circuit breaker.

Figure 2:
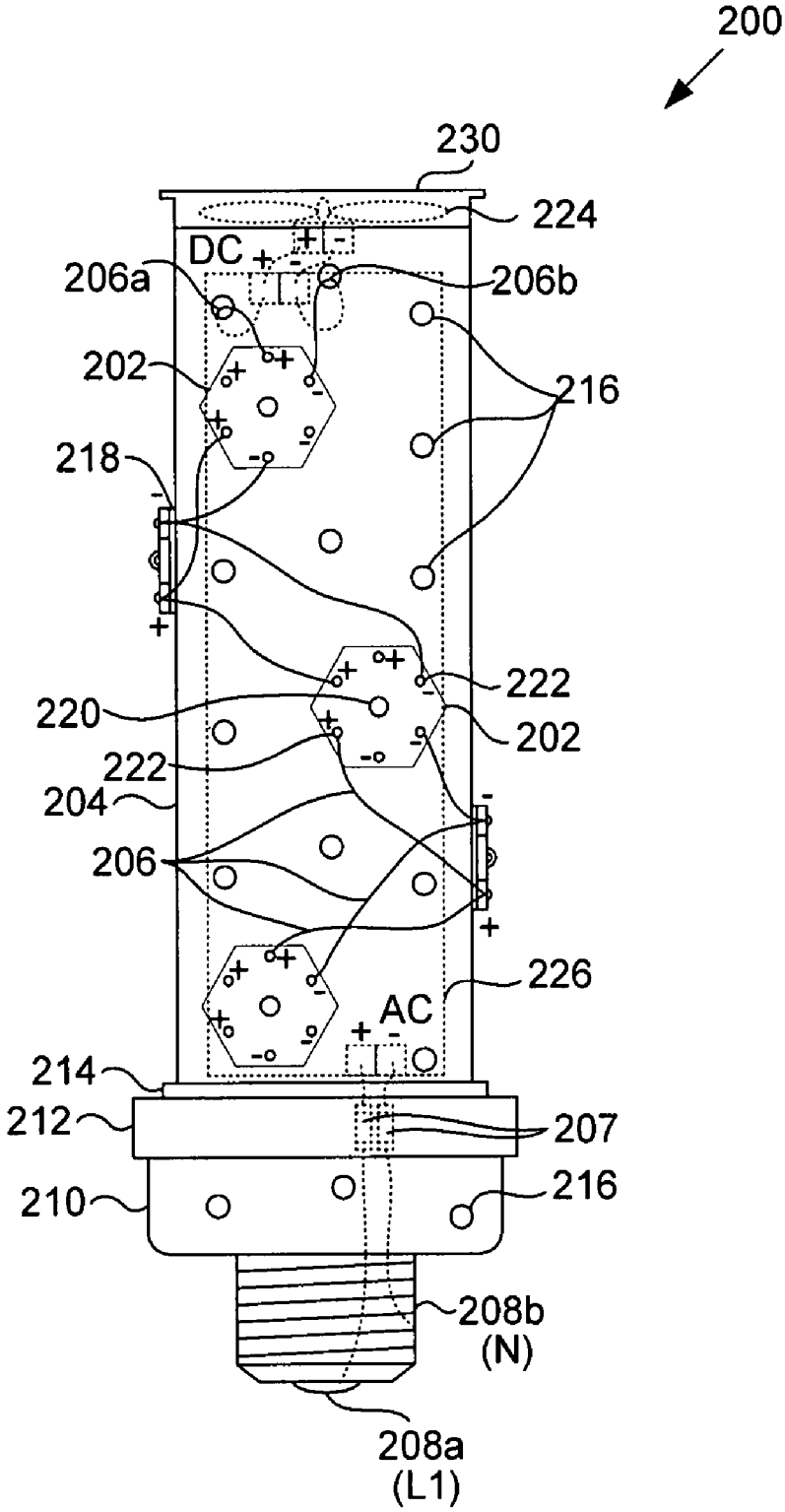
FIG. 2 is a diagrammatic representation of a lighting device according to various embodiments of the present invention.

Next, FIG. 2 is a diagrammatic representation of a lighting device 200 according to a second embodiment of the present invention. Lighting device 200 is similar to lighting device 100. For instance, lighting device 200 includes multiple LEDs 202, a frame 204, interconnects 206 (including 206*a* and 206*b*), connectors 207, electrical contacts 208*a* and 208*b*, chassis 210, outer washer 212, inner washer 214, ventilation holes 216, thermal interface material 218, LED lens 220, connection points 222, and cap 230. However, lighting device 200 also includes an electrical power converter 226 and a fan 224 integrated into cap 230.

The purpose of electrical power converter 226 is to convert one electrical rating to another electrical rating. For example, electrical power converter 226 may be used to convert 120 Volts AC to 24 Volts DC. Any suitable electrical power converter may be used to supply electricity to LEDs 202 or other electrical component of lighting device 200. For example, Advance 10-Watt 350 mA Xitanium LED driver (model/part #LED120A0350C28FO), available from Advance of Rosemont, Ill. Generally, the electricity from power converter 226 at least matches the electrical ratings of the LEDs 202. As shown, electrical power converter 226 is configured to be disposed within frame 204. In the case where frame 204 is a pipe, electrical power converter 226 can slide into the pipe from the end openings (e.g., 124*a* and 124*b* found in FIG. 1).

Fan 224 is shown integrated into cap 230 and is optional. The use of fan 224 may depend on the configuration (e.g., number of LEDs) of the lighting device. Fan 224 is configured to increase the heat dissipation from LEDs 202, frame 204, and/or electrical power converter 226. In the case where frame 204 is a pipe, fan 224 is configured to draw air from inside the pipe to outside the pipe. Both fan 224 and electrical power converter 226 can be interconnected with LEDs 202 with electrical circuitry.

An advantage of lighting devices 100 and 200 is that they could be scalable lighting devices. That is, both lighting device 100 and lighting device 200 can each be configured to allow either a larger or smaller number of lighting elements based on the application. For example, the frame can be selected with a length and pre-wired (e.g., using the lighting element mounting system discussed in FIGS. 7A and 7B) accordingly to receive any suitable number of lighting elements. Therefore, when the application requires more light, more lighting elements can be easily added to the lighting device. Alternatively, when the application requires less light or when the lighting device is too hot, lighting elements can be easily removed from the lighting device. Furthermore, lighting devices 100 and 200 can be configured with dimmer controls.

Figure 3:
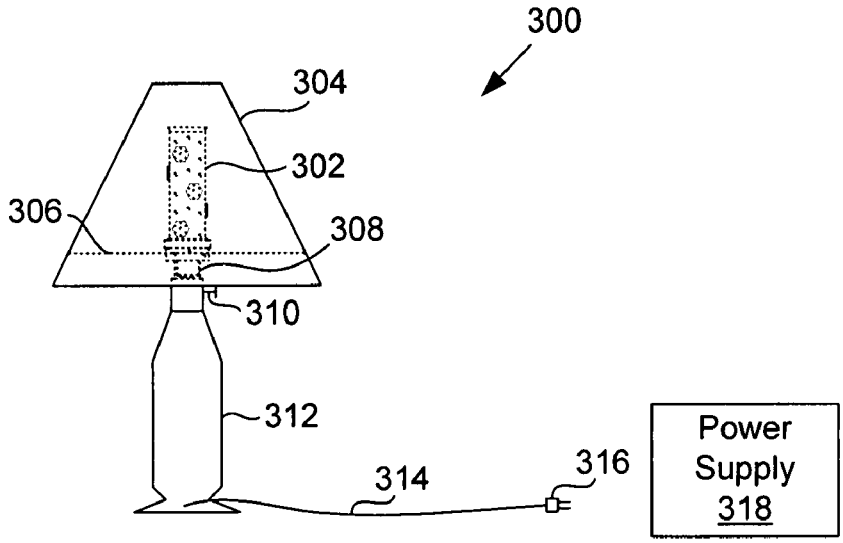
FIG. 3 is a diagrammatic representation of a lighting device system according to various embodiments of the present invention.

FIG. 3 is a diagrammatic representation of a lighting device system 300 according to a first embodiment of the present invention. Lighting device system 300 can resemble a conventional lamp. Lighting device system 300 includes a lighting device 302 (such as lighting devices 100 and 200) powered from a power supply 318. Power supply 318 may be based either on fuel cells, generators, wind power, hydropower, solar power, or thermal power. Power supply 318 is configured to supply electricity to lighting device 302 via an electrical circuit, which may be formed in part by an electrical plug 316, an electrical cord 314, a switch 310, and a socket 308. Generally, lighting device 302, socket 308, switch 310, electrical cord 314, electrical plug 316 and power supply 318 are electrically connected using any conventional mechanism or technique. Switch 310 is often included to control (i.e., via opening or closing the circuit) the electricity flowing between lighting device 302 and power supply 318.

A base 312 is also included in lighting device system 300 to elevate lighting device 302 to an appropriate height from the surface of which base 312 is mounted. Additionally, lighting device system 300 may include a cover 304 optionally supported by a brace 306. Cover 304 and/or brace 306 can be integrated with lighting device 302. In general, cover 304 can be positioned around lighting device 302 such that light from the lighting device 302 can be diffused. Since LEDs are substantially directional, cover 304 can be configured to control the direction of the light emitted from the LEDs. Cover 304 can be any suitable shape for the application. Cover 304 can also be made from any suitable material, such as plastic, glass, or paper. Therefore, cover 304 may be chosen based on the degree of light diffusion, protection of the LEDs, and/or coloration sought for the application. In some cases, cover 304 includes a slot to allow heat from the lighting device 302 to escape through.

Figure 4:
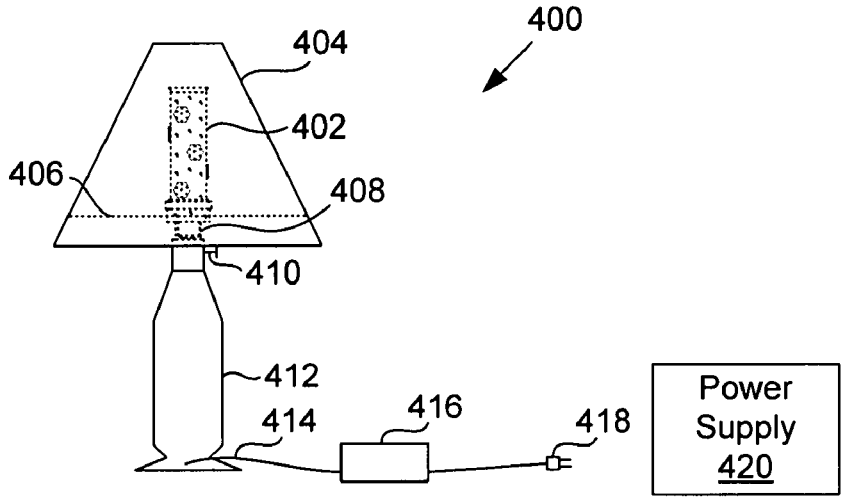
FIG. 4 is a diagrammatic representation of a lighting device system according to various embodiments of the present invention.

FIG. 4 is a diagrammatic representation of a lighting device system 400 according to a second embodiment of the present invention. Lighting device system 400 is similar to lighting device 300. For example, lighting device system 400 also includes a lighting device 402, a cover 404, a brace 406, a socket 408, a switch 410, a base 412, an electrical cord 414, an electrical plug 418, and a power supply 420. However, lighting device system 400 includes an external electrical power converter 416.

Figure 5:
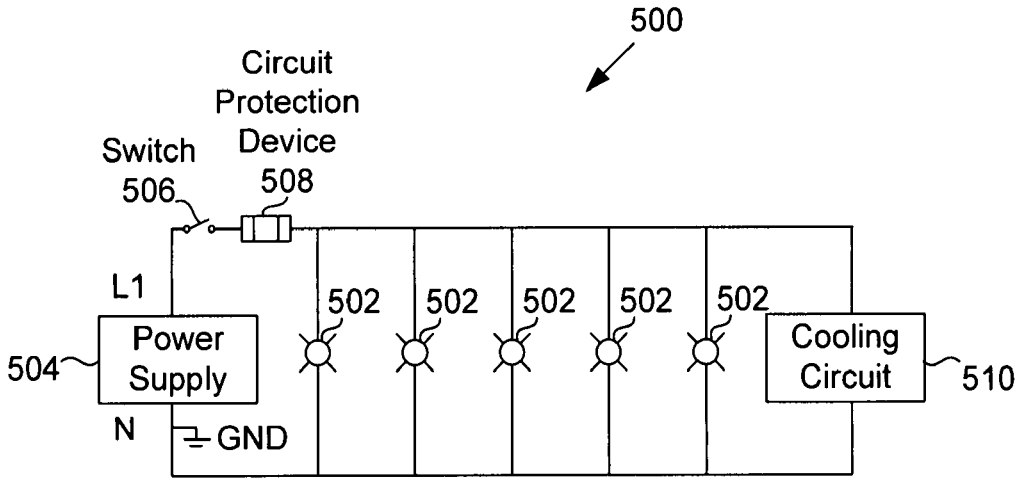
FIG. 5 is a schematic diagram of a lighting device according to various embodiments of the present invention.

FIG. 5 is a schematic diagram 500 of a lighting device according to various embodiments of the present invention. Schematic diagram 500 shows a power supply 504 coupled to multiple lighting elements 502 (e.g., LEDs) connected in parallel with a cooling circuit 510. Cooling circuit 510 can include a fan (e.g., 224 found in FIG. 2) and temperature sensors for controlling the fan. Lighting elements 502 and cooling circuit 510 can be protected by a circuit protection device 508. Furthermore, a switch 506 may be used to control the flow of electricity to them.

Figure 6:
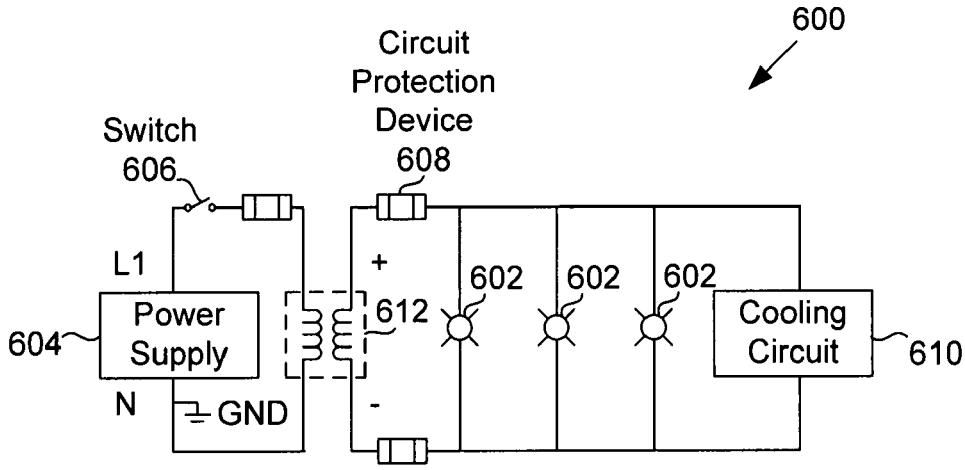
FIG. 6 is a schematic diagram of a lighting device according to various embodiments of the present invention.

FIG. 6 is a schematic diagram 600 of a lighting device according to various embodiments of the present invention. Schematic diagram 600 shows a power supply 604 coupled to an electrical power converter 612, which is further coupled to multiple lighting elements 602 (e.g., LEDs) connected in parallel with a cooling circuit 610. Cooling circuit 610 can include a fan (e.g., 224 found in FIG. 2) and temperature sensors for controlling the fan. Lighting elements 602, cooling circuit 610, and electrical power converter 612 can be protected by various circuit protection devices 608. Furthermore, a switch 606 may be used to control the flow of electricity to them.

Figure 7A:
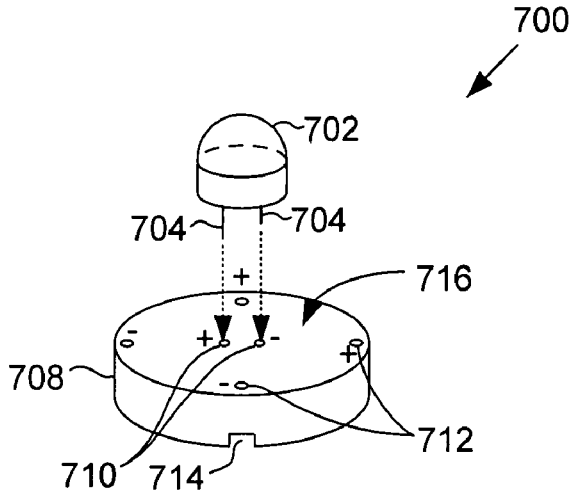
FIG. 7A is a top perspective view of a lighting element mount system having a mount for use with a lighting element according to various embodiments of the present invention.
Figure 7B:
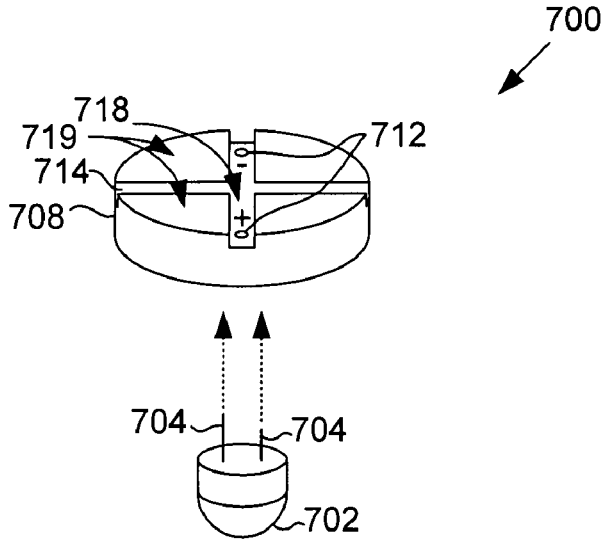
FIG. 7B is a bottom perspective view of a lighting element mount system having a mount for use with a lighting element according to various embodiments of the present invention.

FIGS. 7A and 7B are respectively a top perspective view and a bottom perspective view of a lighting element mount system 700 having a mount 708 for use with a lighting element 702 according to various embodiments of the present invention. Mount 708 is configured to include pin holes 710 for electrically connecting to pins 704 of lighting element 702. Pins 704 are further electrically connected to lighting element 702 whereas pin holes 710 are further electrically connected to connection points 712. The connections between pins 704, pin holes 710, and connection points 712 can be organized based on a common polarity (e.g., "+", "−") or voltage potential (e.g., L1, N). Pin holes 710 and connection points 712 can penetrate mount 708 from an upper surface 716 to an opposite surface 718 such that electrical connections can be made on either surfaces. Generally, mount 708 can be made of any suitable material for providing adequate heat dissipation from the lighting element 702 while not short circuiting the pin holes 710, connection points 712, or pins 704.

Mount 708 also includes grooves/channels 714 configured to allow interconnects to route to the pin holes 710 and/or connection points 712. The bottom surface 719 is configured to attach the mount to any suitable surface, such as a frame of a lighting device (e.g., 100 found in FIG. 1 or 200 found in FIG. 2). Any suitable mechanism or technique may be used for the attachment, such as solder, epoxy, double sided heat sink adhesive tape, machine or sheet metal screws or rivets. In this way, mount 708 can be pre-wired to the frame of a lighting device such that lighting elements 702 can be easily added or removed. It should be noted that the mechanism or technique used to attach the mount to the frame should also provide adequate heat dissipation from lighting element 702.

Figure 8:
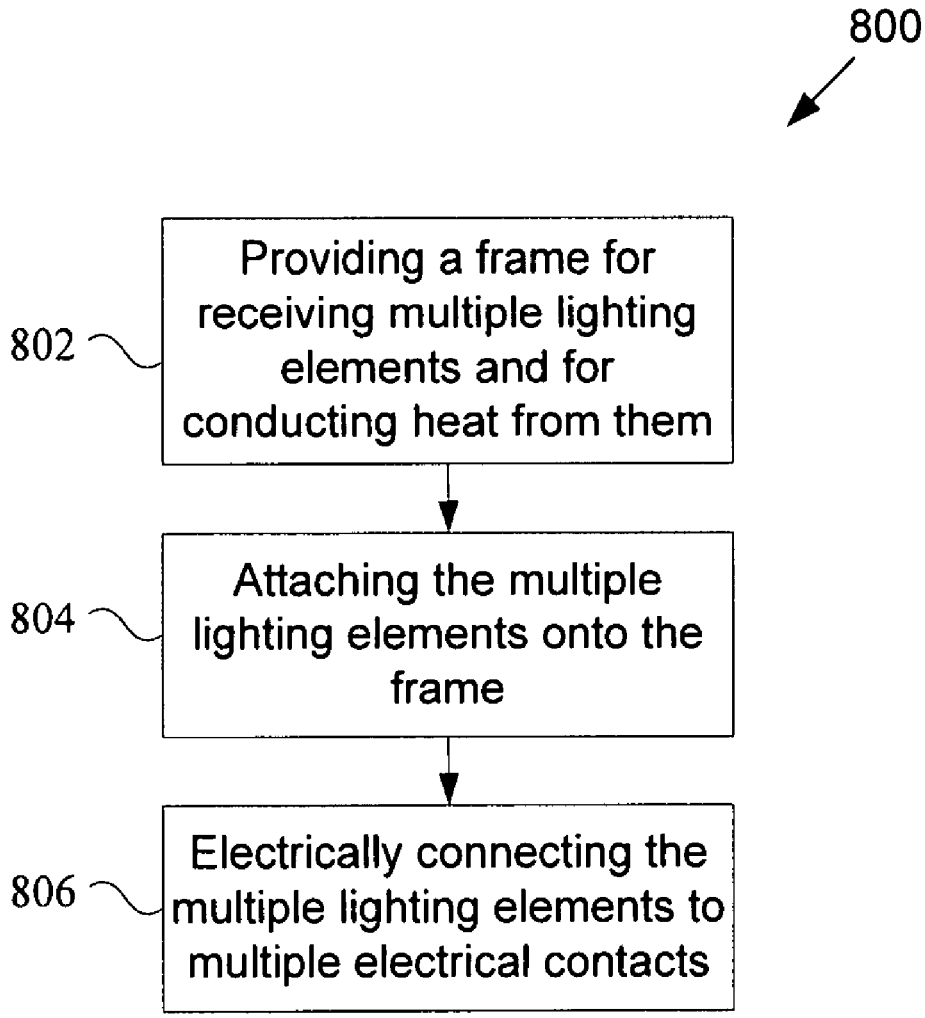
FIG. 8 is a flow chart for forming a lighting device according to various embodiments of the present invention.

FIG. 8 is a flow chart 800 for forming a lighting device according to various embodiments of the present invention. Flow chart 800 begins at operation 802 by providing a frame for receiving multiple lighting elements (e.g., LEDs) and for conducting heat from them. Next, attaching the multiple lighting elements onto the frame can be performed in operation 804. Next, electrically connecting the multiple lighting elements to multiple electrical contacts is performed in operation 806.

Flow chart 800 can be modified in any suitable manner. Operations 802, 804, and 806 can either be repeated or modified to suit the application. For example, flow chart can include the following operations:

1) Drill holes in pipe (e.g., 104 found in FIG. 1, 204 found in FIG. 2) approximately ¾" apart for mounting LEDs (e.g., 102 found in FIG. 1, 202 found in FIG. 2) and for vent holes (e.g., 116 found in FIG. 1, 216 found in FIG. 2).

2) Drill holes around chassis (e.g., 110 found in FIG. 1, 210 found in FIG. 2) and on the top of the cap (e.g., 130 found in FIG. 1, 230 found in FIG. 2) for additional venting.

3) Strip the end of one long wire (e.g., 106 found in FIG. 1, 206 found in FIG. 2) and solder it to a positive (+) marked connector (e.g., 122 found in FIG. 1, 222 found in FIG. 2) of one of the LEDs.

4) Strip both leads of the low voltage connector wires (e.g., 206*a*, 206*b* found in FIG. 2) and note the positive (+) lead as it will be connected to the power supply (e.g., 226 found in FIG. 2) later.

5) Determine locations of LEDs along the pipe and feed the opposite end of the positive lead connected to the LED into the appropriate hole and through to the bottom of the pipe.

6) Slip a piece of heat shrink tube (e.g., 107 found in FIG. 1, 207 found in FIG. 2) over the positive lead of the low voltage wire connector. Twist together and solder the LED positive lead wire to the low voltage positive connector lead.

7) Slide the heat shrink tube on the positive low voltage wire connector over the soldered wire leads. Use a hot air blower to heat and shrink the tubing to complete insulation of the soldered connection.

8) Strip and solder a wire lead to a negative (−) connection point on the LED and feed the opposite end of the lead through an adjacent hole in the pipe.

9) Attach a small piece of double-sided heat sink tape (e.g., 118 found in FIG. 1, 218 found in FIG. 2) to the back of the LED star mount and carefully feed the positive and negative leads into the pipe. Secure the LED to the pipe with the tape and by pulling the two leads snugly.

10) Pass the opposite end of the negative lead through to the outside of the pipe through a hole adjacent to the location of the next LED to be mounted.

11) Solder a wire lead to a negative post of the next LED. Feed the lead into the pipe through the next adjacent hole. Attach double-sided heat sink tape to the back of the LED star and mount it to the pipe so the positive connection point is ready to be soldered to the negative lead of the first LED.

12) Cut, strip and solder the negative lead of the first LED to the second LED positive (+) connection so mounting is snug.

13) Repeat the procedure and wire one LED negative (−) connection to the next LED positive (+) connection in series by weaving the wires in and out of the pipe and fastening the LEDs to the pipe with tape and snugly soldered connections.

14) Solder a long wire lead to the last LED negative connection so it can be passed through the pipe and be soldered to the negative lead of the low voltage connector and shrink tube insulated as performed earlier for the positive lead.

15) Pass the low voltage wire connector assembly through the washer (e.g., 112 found in FIG. 1, 212 found in FIG. 2) and slide the washer over the pipe.

16) Repeat operation 15 with another washer (e.g., 114 found in FIG. 1, 214 found in FIG. 2) and set aside the pipe and LED assembly.

17) Connect the negative lead (N1- e.g., 208*b* found in FIG. 2) of the chassis to the "neutral" push connection of the power supply.

18) Connect the positive lead (L1- e.g., 208*a* found in FIG. 2) of the chassis to the positive "line" connection of the power supply.

19) Attach the low voltage connector to the power supply. Carefully slide the power supply through the pipe being careful of the wiring until the pipe assembly rests at the bottom of the inside of the chassis.

20) Before final assembly, test the pipe light to insure all LEDs are functional.

21) Hold LED pipe assembly firmly butted against the bottom of the chassis and slide washer (e.g., 114 found in FIG. 1, 214 found in FIG. 2) along the outside of the pipe into the chassis. Adjust the pipe and chassis so washer and pipe sit flush and straight along the top edge of the chassis and around the pipe.

22) Repeat operation 21 with washer (e.g., 112 found in FIG. 1, 212 found in FIG. 2) but slide the washer over the top of the chassis to rest along the top edge.

23) Slide cap on the end of the pipe and replace any lamp bulb with the same socket as used for chassis with the pipe light.

EXAMPLES

The following examples provide details concerning lighting devices in accordance with specific embodiments of the present invention. It should be understood the following is representative only, and that the invention is not limited by the detail set forth in these examples.

Temperature tests were performed on three pipe light embodiments constructed from conventional sink drainpipes, Advance Transformer Company power supplies available from Future Electronics of Montreal, Quebec, Canada, and standard screw in light 120 AC volt socket adapters. Each pipe light was turned on for substantially twenty-four continuous hours. Various temperatures were measured using thermal sensors placed in strategic locations on each light. For example, one sensor was along the pipe exterior (e.g., outer surface 126 found in FIG. 1), typically between 2 LEDs, approximately ¾" apart from the center of each LED dome lens (e.g., 120). A second sensor was placed inside the pipe, but did not touch the interior sides (e.g., inner surface 128) of the pipe unless noted otherwise. A pipe (i.e., P2) which had the LEDs placed to direct light in one direction had an additional sensor placed on the exterior backside of the pipe, farthest away from the LEDs. To record extreme temperatures, one lamp (i.e., P2) had a sensor placed at times under the LED against its base and the pipe. Ambient room temperature was recorded during the entire test.

No cooling fans were used to vent any heat from the pipe lights. All light pipes were constructed with 1.5" sink drain tailpipe remnants having 16 to 18-gauge brass interior and chrome plated exterior. The LEDs were wired with 16-gauge wire, which was weaved into the pipe through vent holes that were drilled around the pipe. The wire was heat rated at 105 degrees Celsius. The weaving of the LED wiring into the pipe helped mount the LED against the pipe. In some cases double-sided tape had been added to the back of the LED to create a more direct coupling to the pipe for better heat sink transfer. Since the 1.5" pipe created a tight circumference, the dime-sized LED mount touched the pipe directly under the LED dome. This created a fin-like structure where the "dime" extended off the surface/edge of the pipe. The fin effect, as well as the additional venting holes around the pipe top cap and base chassis added to the lowered thermal resistance. Since Luxeon III LEDs burned out in an earlier prototype at only 700 mA described below, and the life expectancy of 1,000 hours for the Luxeon V was limiting, the Luxeon Vs were not tested.

According to a first embodiment, Pipe Light 1 (P1) was about 5.5" long from the pipe end to the base point of the light socket screw-in adapter. Eight Luxeon III 3-Watt LEDs (model/part #LXHL-LW3C), available from Lumileds Lighting, LLC of San Jose, Calif. or from Future Electronics of Montreal, Quebec, Canada, were spaced evenly around the pipe, approximately 1" apart. P1 was intended to mimic the light effects of a standard incandescent light bulb. A standard table lamp was used, plugged into a power supply, which converted 120 AC to the DC low voltage requirement of the LEDs.

The power supply was an Advance Xitanium driver (model/part #LED120A0024V10F), available from Future Electronics of Montreal, Quebec, Canada, that provided 1050 mA constant current. The LEDs were arranged in a 2×4 configuration, where series of 2 LEDs in parallel were drawing 525 mA each (instead of 700 mA or 1050 mA). To further reduce possible overheating, the power supply was external to the pipe, which created a voltage drop between the external power supply DC connection and the first LED in the sequence. An estimate of approximately 475-500 mA of current was supplying the eight LED IIIs of P1. The LEDs on P1 were secured to the pipe using double-sided heat sink tape.

It should be noted that, according to Luxeon specifications, the Luxeon III LEDs could be driven at 700 mA or 1050 mA. However, in an earlier prototype, six Luxeon III LEDs connected in series were driven at 700 mA. The LEDS grew so hot that the wire insulation and soldered connections emitted an odor resembling melting insulation and the solder flux burned a darker brown. In order to stress test the device driven at 700 mA, the Luxeon III LEDs were not securely mounted to the pipe. Some LEDs were allowed to barely touch the mounting pipe so that heat transfer and dissipation would be inadequate.

The stress test proved worthwhile as after only a few hours of using the lamp, on the second day, one LED started to dim during operation. On the third day it failed altogether while all other LEDs were still functioning. However, by the end of the third day, a second LED started to dim. On the fourth day the first failed LED looked permanently damaged and never worked again. The second failing LED continued to dim, but when pressed firmly against the pipe grew momentarily brighter. This was consistent with the first LED's failure. The test was stopped after the pattern of LED failures continued.

Another earlier prototype involved using a paper cardboard frame, such as a toilet paper roll, for supporting the LEDs of the lighting device. Silicone was also used to attach the LEDs and to provide strength within the paper cardboard frame. However, the paper cardboard frame had poor heat conducting properties. As such, a pipe light mount configuration that facilitates heat dissipation (e.g., such as in a heat sink) from the LEDs in accordance to various embodiments of the present invention could significantly improve the performance (e.g., maximizing the life spans) of the LEDs.

According to a second embodiment, Pipe Light 2 (P2) was approximately 7.5" long from the pipe end to the base point of the light socket screw-in adapter. Eight Luxeon I 1-Watt LEDs (model/part #LXHL-MWGC), available from Lumileds Lighting, LLC of San Jose, Calif. or from Future Electronics of Montreal, Quebec, Canada, were configured in series using an Advance 10 watt 350 mA Xitanium LED driver (model/part #LED120A0350C28FO), available from Future Electronics of Montreal, Quebec, Canada. In this configuration, 350 mA were delivered to each LED. A series configuration for 1 to 8 LEDs is recommended for this driver with 1 watt LEDs.

P2 was configured to have eight LEDs, 4 rows×2 columns, so that the light emitted from the lamp was directed in an approximate 45-degree angle. P2 can be used to replace an incandescent light bulb where the lamp stand is placed in the corner of a room, or in a plumber's droplight lamp holder. In both these situations light should be directed outward into the room and not back into the corner or into the plumber's face. In this specific embodiment, the power supply was concealed inside the pipe. This "bulb" can be inserted into any suitable standard screw in light socket provided that space is available. On P2, the LEDs were attached firmly to the pipe, but no double-sided tape or any other additional heat sink transferring agents were used.

According to a third embodiment, Pipe Light 3 (P3) was approximately 7.25" long from pipe end to the base of the light socket adapter. It had six Luxeon III 3-Watt LEDs (model/part #LXHL-LW3C) mounted approximately 1" apart between dome centers. The LEDs were attached firmly to the pipe and double-sided heat sink tape was used. P3 was intended for corner or droplight use and spreads light in approximately a 45-degree angle.

In this configuration, an Advance 17 watt 700 mA Xitanium LED driver (model/part #LED120A0700C24FO), available from Future Electronics of Montreal, Quebec, Canada, was used and mounted inside the pipe, thereby allowing P3 to be a direct replacement of a standard incandescent bulb. The LEDs were arranged electrically in series, 2 in parallel, in a 2×3 manner. In this configuration, 3-Watt LEDs were driven at 350 mA. However, it should be noted that 1-Watt LEDs can be substituted in this configuration and also driven at 350 mA, in which more LEDs can be added, 2 at a time, for a total of twelve 1-Watt LEDs.

Table 1 indicates the sensor locations for each pipe light and the measuring devices used.

TABLE 1

| Data Logger* | Thermistor** | Pipe Light | Sensor Location |
|---|---|---|---|
| PL004 | TH031 | N/A | ambient temp. |
| | TH036 | P2 | pipe surface, lit side |
| | TH037 | P2 | pipe interior |
| | TH039 | P2 | pipe surface, backside |
| PL010 | TH040 | P3 | pipe interior |
| | TH042 | P3 | pipe surface, lit side |
| | TH046 | P1 | pipe surface |
| | TH048 | P1 | Pipe interior |

*PACE Scientific XR440 "Pocket Logger"
**PACE Scientific "Type C" Thermistors

The temperature tests involved running the pipe lights for a 24-hour period. The pipe lights were turned on at 11:23. The sampling rate was set to 1 minute. However, at 12:48, TH036 was moved so tip of probe was wedged between pipe surface and underside of LED base. At 13:17, lamp power supplies were briefly shut off to reroute power cords. At this time, P3 pipe interior sensor TH040 fell into the pipe and started touching the interior pipe surface (e.g., inner surface 128).

Figure 9:
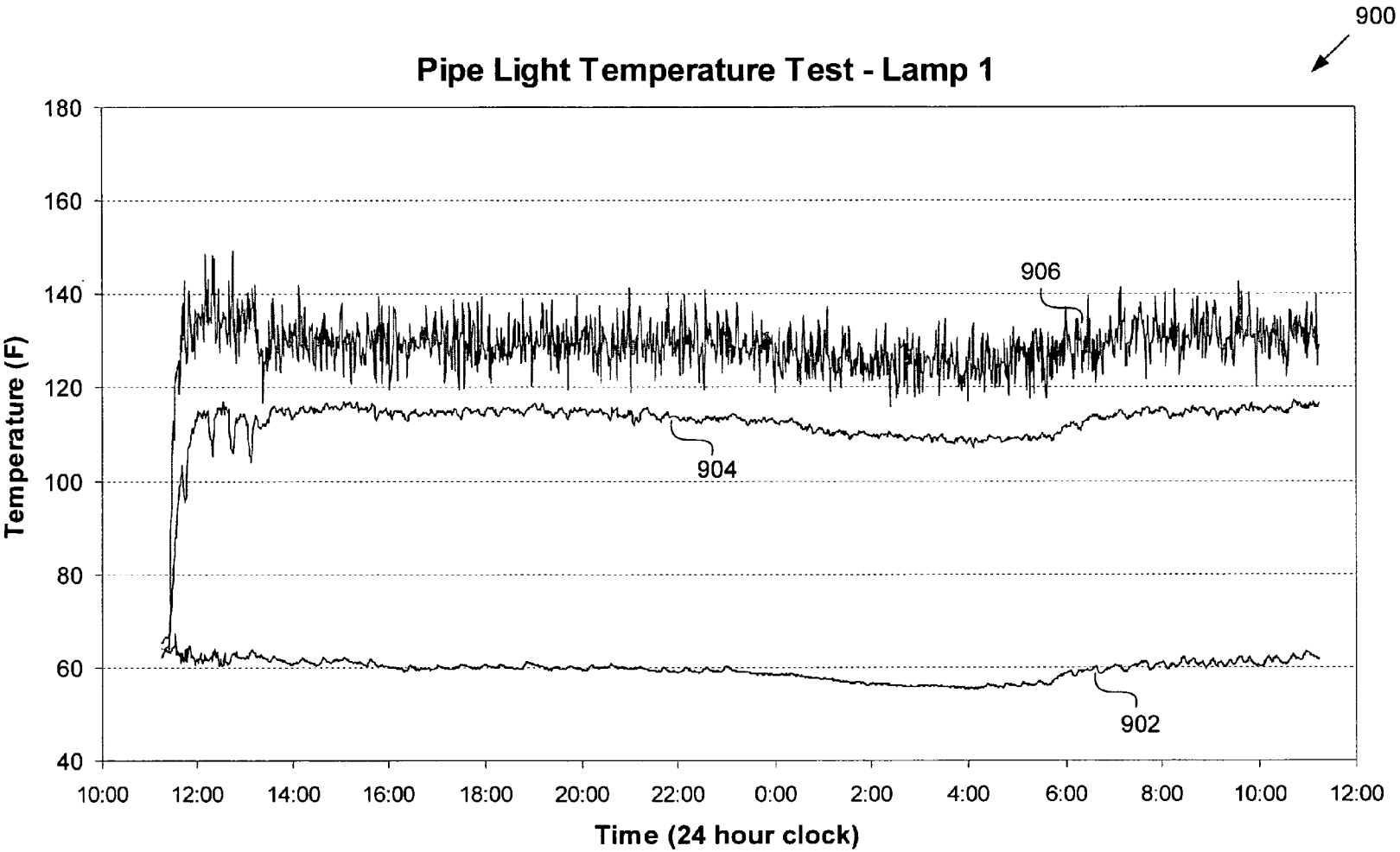
FIG. 9 illustrates a graph plotting temperature versus time for one embodiment of the present invention.
Figure 10:
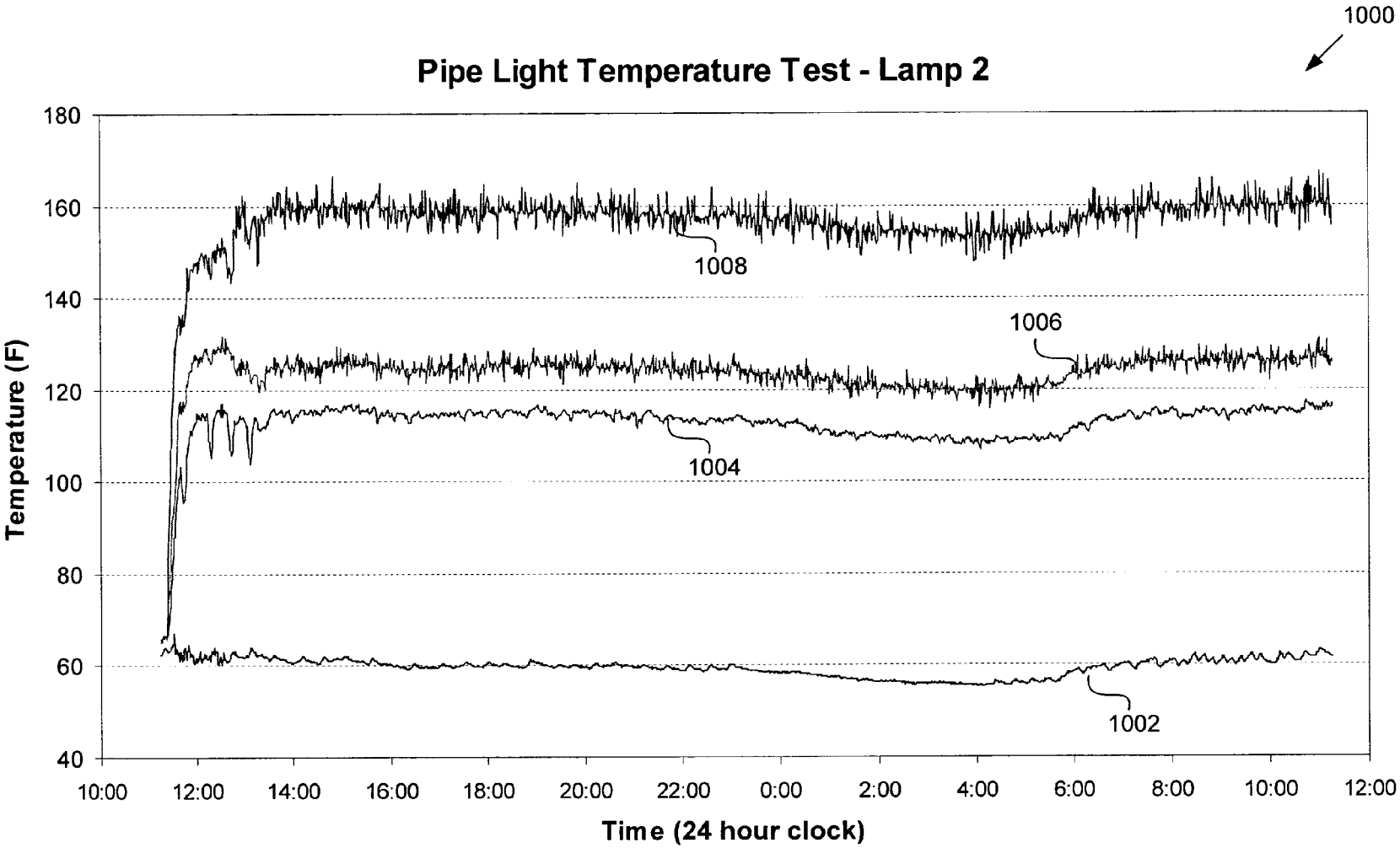
FIG. 10 illustrates a graph plotting temperature versus time for another embodiment of the present invention.
Figure 11:
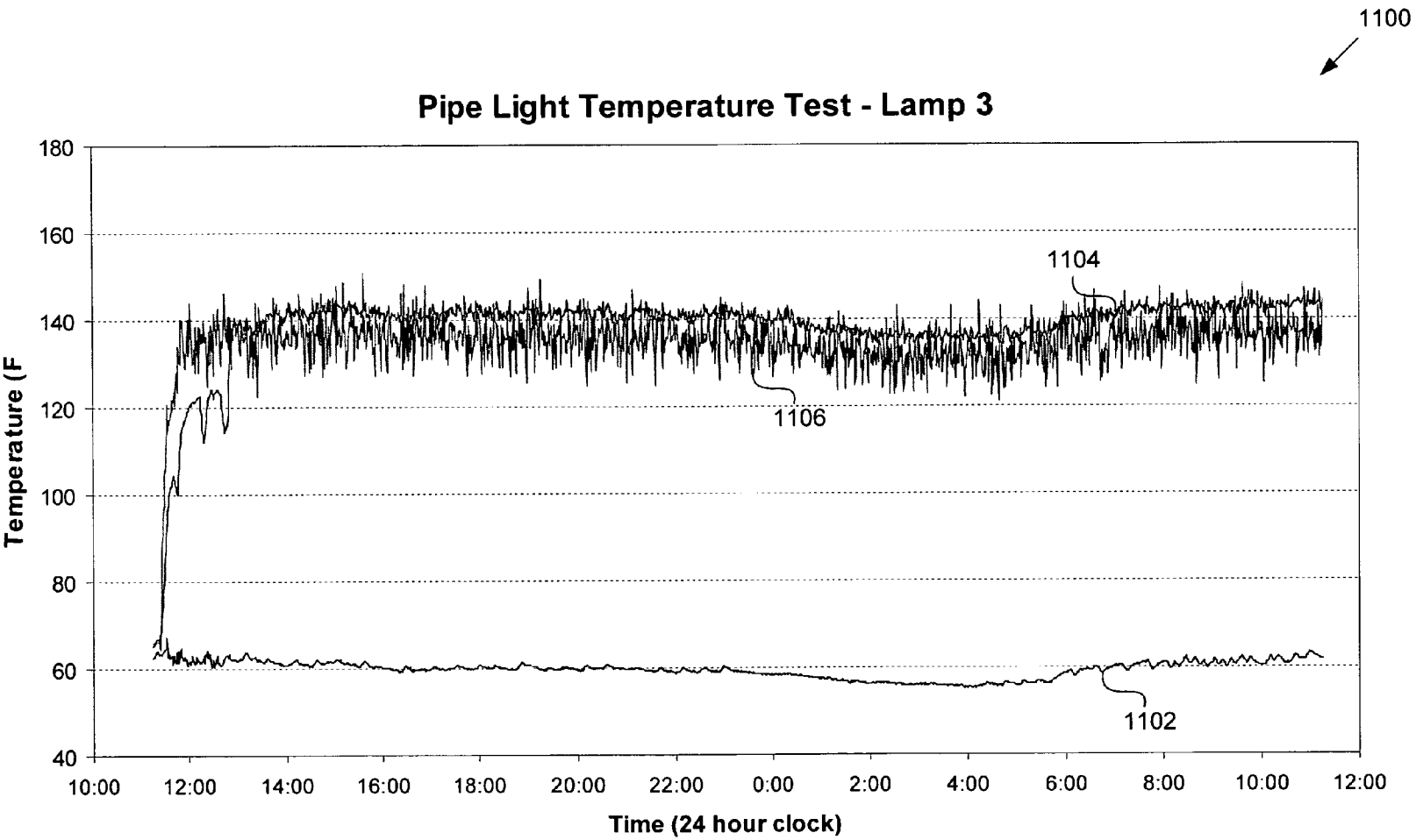
FIG. 11 illustrates a graph plotting temperature versus time for yet another embodiment of the present invention.

A complete recording of the measured temperatures from the sensors indicated in Table 1 is shown in FIGS. 9, 10, and 11. FIG. 9 illustrates a graph 900 plotting temperature versus time for the first embodiment. Measurement 902 (measured by TH031) is the ambient room temperature whereas measurement 904 (measured by TH048) is the pipe interior temperature and measurement 906 (measured by TH046) is the pipe surface temperature (e.g., outer surface 126 found in FIG. 1). FIG. 10 illustrates a graph 1000 plotting temperature versus time for the second embodiment. Measurement 1002 (measured by TH031) is the ambient room temperature whereas measurement 1004 (measured by TH037) is the pipe interior temperature, measurement 1006 (measured by TH039) is the pipe surface (back side—e.g., outer surface 126 found in FIG. 1 away from the LEDs) temperature, and measurement 1008 (measured by TH036) is the pipe surface temperature (light side—e.g., outer surface 126 found in FIG. 1 near the LEDs). FIG. 11 illustrates a graph 1100 plotting temperature versus time for the third embodiment. Measurement 1102 (measured by TH031) is the ambient room temperature whereas measurement 1104 (measured by TH040) is the pipe interior temperature, and measurement 1106 (measured by TH042) is the pipe surface temperature (light side).

In general, as shown in FIGS. 9, 10, and 11, the tests for all three embodiments resulted in pipe light temperatures that remained consistent throughout the 24-hour test after the initial warm up. The pipe light temperatures lowered slightly in the early morning hours as the ambient temperature lowered. The highest pipe light temperature recorded was taken from P2, Thermistor TH036, after it had been moved directly under an LED between the pipe and the LED base (e.g., the star shaped mounting plate). The temperature at Thermistor TH036 remained at or near 160 degrees Fahrenheit throughout the remainder of the 24-hour test.

Additionally, spot readings were conducted with a Hart Sci. 1521. Table 2 shows temperature samples measured from LEDs on each pipe light. The samples were measured sequentially in the order shown in Table 2. The samples were taken with the tip of the sensor placed on top of the LED dome. Dome temperature tests for each LED were not recorded, but sampling indicated consistent temperatures.

TABLE 2

| Time | Pipe Light | Temp (° F.) |
|---|---|---|
| 12:55 | P1 | 106 |
| 12:59 | P2 | 86.5 |
| 13:00 | P3 | 84 |
| 20:54 | P1 | 86.5 |
| 20:59 | P2 | 87.6 |
| 21:04 | P3 | 86.2 |
| 12:41 | P1 | 91 |
| 12:43 | P2 | 87 |
| 12:46 | P3 | 83.3 |

Figure 12A:
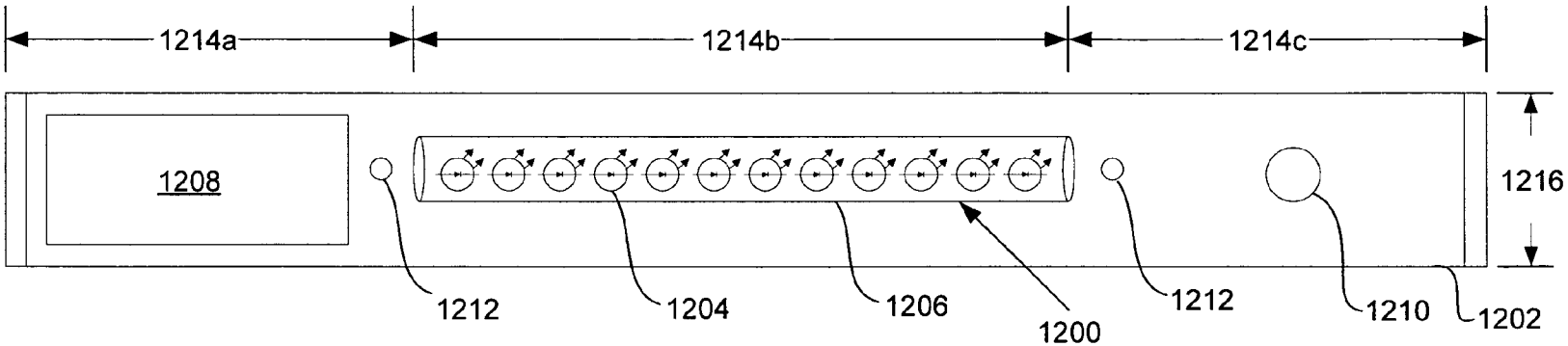
FIG. 12A is a top view of a lighting device within an enclosure (covers removed) according to various embodiments of the present invention.

FIG. 12A is a top view of a lighting device 1200 within an enclosure 1202 (covers removed) according to various embodiments of the present invention. Lighting device 1200 includes multiple LEDs 1204 mounted onto a frame 1206, which is set and attached within enclosure 1202. LEDs 1204 are electrically connected to a power converter 1208, which is also set and attached within enclosure 1202. Enclosure 1202 can be made from any suitable material for securing the lighting device. For instance, enclosure 1202 can be made from any metal such as aluminum. Enclosure 1202 can also be of any suitable size (e.g., width 1216, lengths 1214(*a-c*), depth 1218) for receiving the lighting device, power converter, and electrical circuitry (not shown). Enclosure 1202 can also be configured with any number/size of knock outs 1210 to facilitate wiring (e.g., electrical circuitry for providing power to the lighting device via the electrical converter) and mounting holes 1212 to facilitate attaching the enclosure onto a surface (e.g., ceiling).

In a specific embodiment, lighting device 1200 includes a ½" aluminum conduit with LEDs spaced evenly apart. The conduit is configured as a wire raceway and has many holes for LED mounting and for heat ventilation generated by the LEDs. Conduit length varies depending on number and spacing of LEDs. In this specific embodiment, LEDs are spaced at 1" or more apart. The enclosure is an aluminum vertical blind head rail. The power converter includes any suitable LED driver, such as Xitanium LED Driver (model/part # LED-120A-0700C-24F), available from Advance of Rosemont, Ill. The Xitanium LED-120A-0700C-24 can drive up to 12 LEDs, 2 legs of 6 in series.

In this example, interconnects, such as 24, 22 or 20 gauge low voltage black and red interconnects from driver to the LEDs, can be wired through the aluminum conduit and soldered to the LED solder pads (e.g., connection points 122). Enclosure 1202 includes a 3/16" mounting hole and a 7/8" knock out for rough in wiring connections to 18 gauge black and white LED driver 110 AC inputs via screw caps. Green 18 gauge connects to aluminum conduit mounting screw for grounding. Dimensions include width 1216 being 1 5/16", lengths 1214*a* and 1214*c* being 6½" each, and depth 1218 being 1 5/16". A two or three prong power cord assembly can be substituted for the rough in knock out.

Figure 12B:
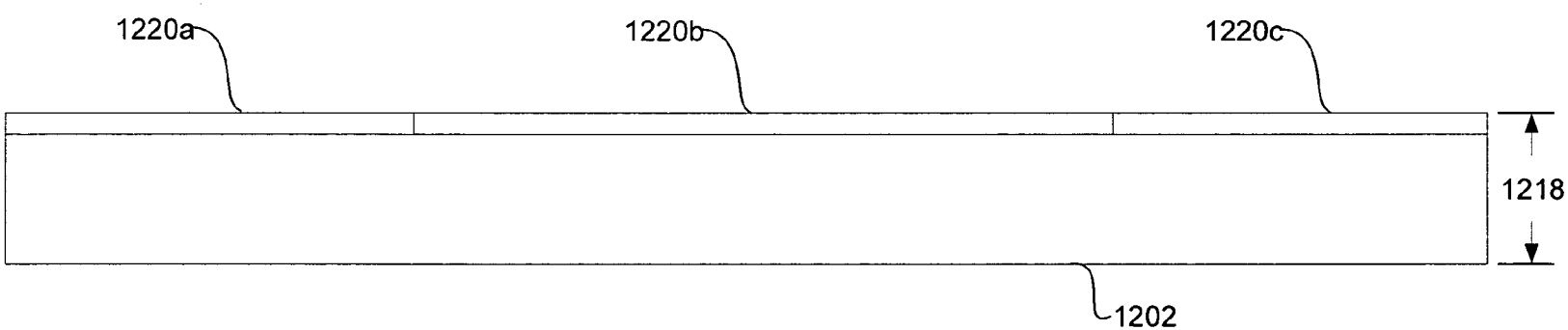
FIG. 12B is a side view of the enclosure (covers attached) in FIG. 12A.

FIG. 12B is a side view of the enclosure (covers attached) in FIG. 12A. Covers 1220*a*, 1220*b*, and 1220*c* are shown attached to enclosure 1202. In general, covers 1220(*a-c*) are configured to provide access to the inside of enclosure 1202. As such, installing and maintaining the lighting device 1200, power converter 1208, and electrical circuitry can be realized. Covers 1220(*a-c*) can be made from any suitable material, such as plastic or glass. According to a specific embodiment, covers 1220*a* and 1220*c* are plastic cover plates whereas cover 1220*b* is a plastic light diffuser.

Figure 13:
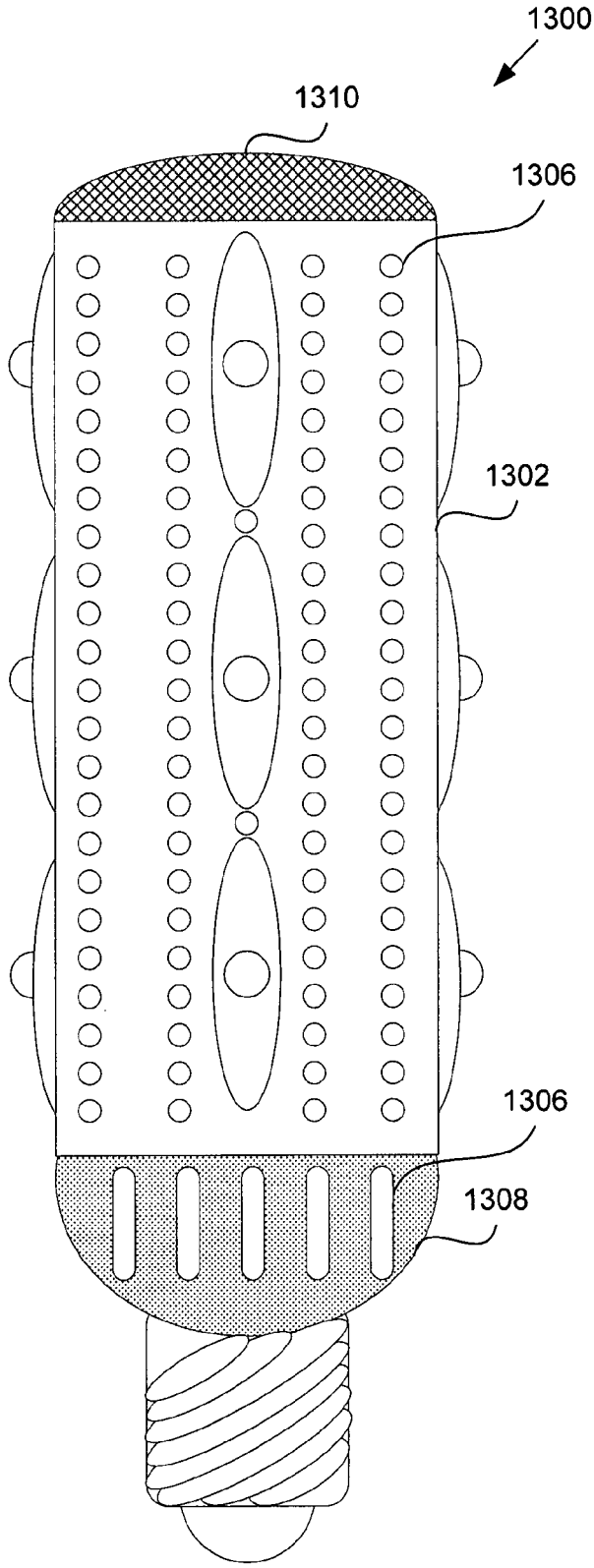
FIG. 13 is a diagrammatic representation of a lighting device with a sheet metal frame according to various embodiments of the present invention.

FIG. 13 is a diagrammatic representation of a lighting device 1300 with a sheet metal frame 1302 according to various embodiments of the present invention. Frame 1302 can be coated with a heat absorbing color (e.g., black) and/or material. Frame 1302 can be any shape cross section such as round, elliptical, square, rectangular, pentagon, hexagon, etc. According to a specific embodiment, frame 1302 is hollow shaped and made of a heat conducting material, e.g., aluminum pipe. Frame 1302 can have minimal interior volume as long as air can pass through and/or around it. However, interior volume should be as large and unobstructed as possible to ensure maximum heat transfer and air flow. A single line of LEDs or multiple lines of LEDs can be configured around and/or staggered around the frame. Frame 1302 can be a few inches to several feet long. LEDs can be spaced one to several inches apart.

Optional ventilation holes and/or slots 1306 allow air to flow through the frame and chassis. Ventilation holes 1306 can be made larger in diameter on each side of the LED mounts for easy wire pass through assembly and better heat convection. Chassis 1308 can be constructed of heat resistant plastic or a ceramic material. Chassis 1308 can be configured with any conventional base, such as an incandescent screw type, fluorescent tube pins, automobile bulb base, etc. Chassis 1308 is coupled to frame 1302 using any suitable mechanism or technique such as glue, epoxy, twist or snap in, etc.

Lighting device 1300 includes a cap 1310, such as a snap in grill cap, that can be configured with an optional LED (e.g., lighting element 702) and mount (e.g., mount 708). Optional through hole mounts can be riveted to frame 1302. LEDs configured to plug into the mounts can be used. As such, an assembly line can insert any color LED in each mount. If constant current LED drivers are used, mounts can have jumpers (or similar mechanisms such as the way a power jack works) instead of LEDs. To increase light intensity, the jumpers can be replaced with LEDs. Mounts can have 2, 3, or 4 (two positives, two negatives) wire straps (cable, ribbons) that pass through into the center of the frame. Straps can have connectors on either or both ends to connect to the mount and the main harness (not shown). The main harness can run from an optional LED driver to the LEDs and connect to each LED with one or more parallel legs of LEDs in series via the 2, 3, or 4 wire strips. Optional LED driver (not shown) can be located in either the interior of the frame or the chassis. LEDs and LED driver are connected via electrical circuitry, which includes the main harness and wire straps. As such, power can be delivered to the LEDs.

In general, frame 1302 is constructed with sheet metal. In some embodiments, the mount and ventilation holes are stamped, drilled or punched before the frame is shaped. LEDs and/or mounts, straps and harnesses can be assembled and connected before or after the sheet metal is formed into a tube or similar shape. Optionally, the tube can be ceiled or welded along the connecting edges of the sheet metal forming the frame. Alternatively, the connecting edges can be spot welded in places so that wiring can be passed along the open slits for easy assembly. In the absence of formed sheet metal, copper or aluminum pipe can be used (preferably pre-drilled).

Figure 14A:
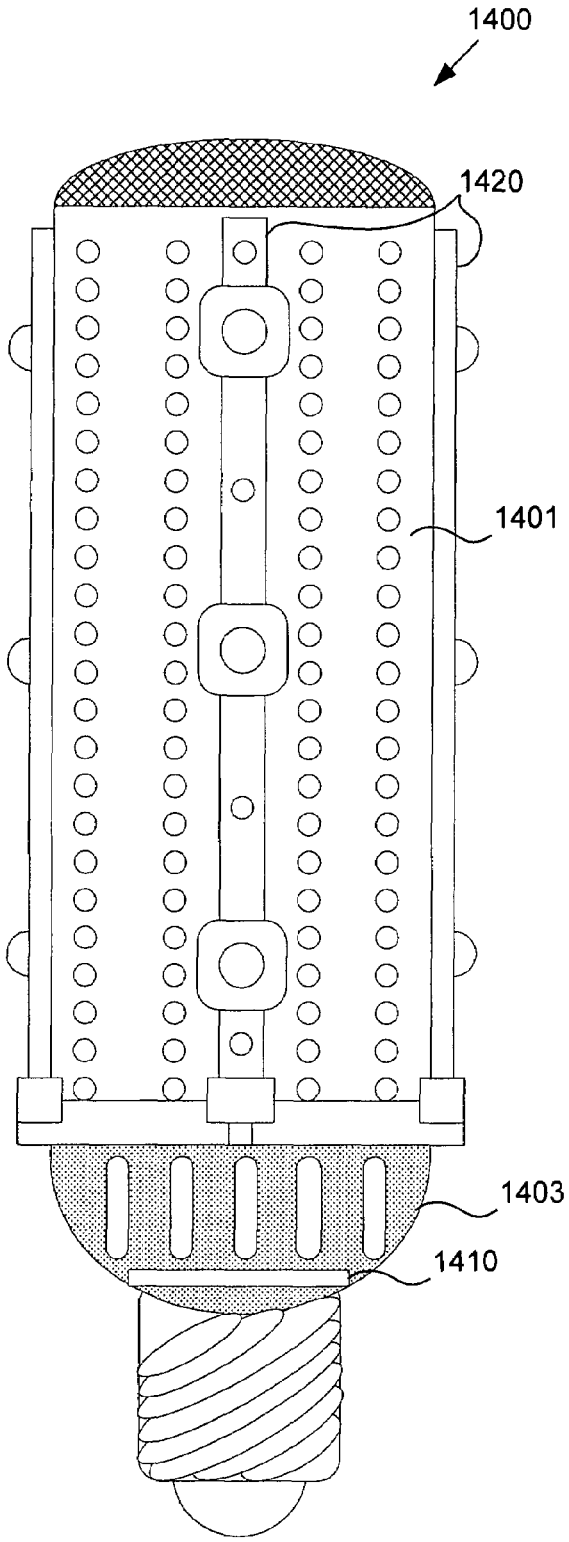
FIG. 14A is a diagrammatic representation of a lighting device with smart bulb features according to various embodiments of the present invention.
Figure 14B:
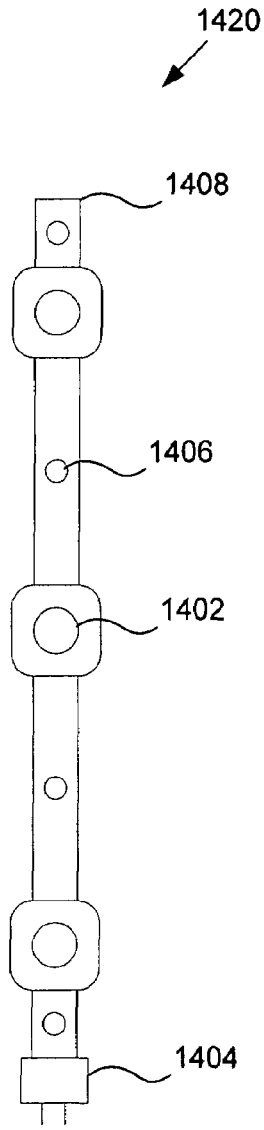
FIG. 14B is a diagrammatic representation of a modular LED subassembly for mounting onto the lighting device in FIG. 14A.

FIG. 14A is a diagrammatic representation of a lighting device 1400 with smart bulb features according to various embodiments of the present invention whereas FIG. 14B is a diagrammatic representation of a modular LED subassembly 1420 for mounting onto the lighting device in FIG. 14A. Subassembly 1420 is an approximately ⅛" thick aluminum backed circuit board 1408 with surface mount LEDs 1402 or pre-packaged LEDs (on a small circuit board). Subassembly 1420 connects LEDs either in series or parallel. Subassembly 1420 can be constructed using an assembly line with reflow solder or other conventional process. Positive and negative connector terminals 1404 plug into outside edge of chassis 1403. After the terminals are pushed into the chassis, subassembly 1420 mounts to the frame 1401 with rivets, machine screws, epoxy, etc. via mounting holes 1406.

Frame 1401 has multiple slots for inserting multiple subassemblies 1420. Chassis is configured to resolve parallel and serial connections between multiple subassemblies 1420. For example, 2 subassemblies 1420, of 3 LEDs in series, are connected and construct a 6 LED leg. A second series of 6 LEDs is constructed using 2 more subassemblies 1420 and creates 2 legs of 6 LEDs for a total of 12 LEDs in a 2 by 6 arrangement.

A smart strip 1410 for implementing "smart" features in lighting device 1400 may include any number of sensors, for example a light sensor to detect changes in ambient light conditions and relay the information to a controller. The controller can be programmed to turn on all lighting devices for a period of time after dusk. The light sensor data of each lighting device can be transmitted to the controller and used to vary the light intensities around a room to maintain consistent light levels throughout. An optional remote control (not shown) can be used to adjust dimming of multiple lighting devices using variable voltage drivers or pulse width modulation dimming. It will be appreciated by those skilled in the art that other sensors and configurations can be used to implement various smart features in lighting device 1400. Additional "smart" features incorporate occupancy or motion detectors in the chassis or the remote control unit. One or more lighting devices can be turned on automatically when an occupant enters a room. To further enhance the smart features of the present invention, the chassis can be used as an antenna to send and receive signals to and from a remote control device. Generally, the chassis is a metal pipe or tube and is electrically neutral.

Figure 15A:
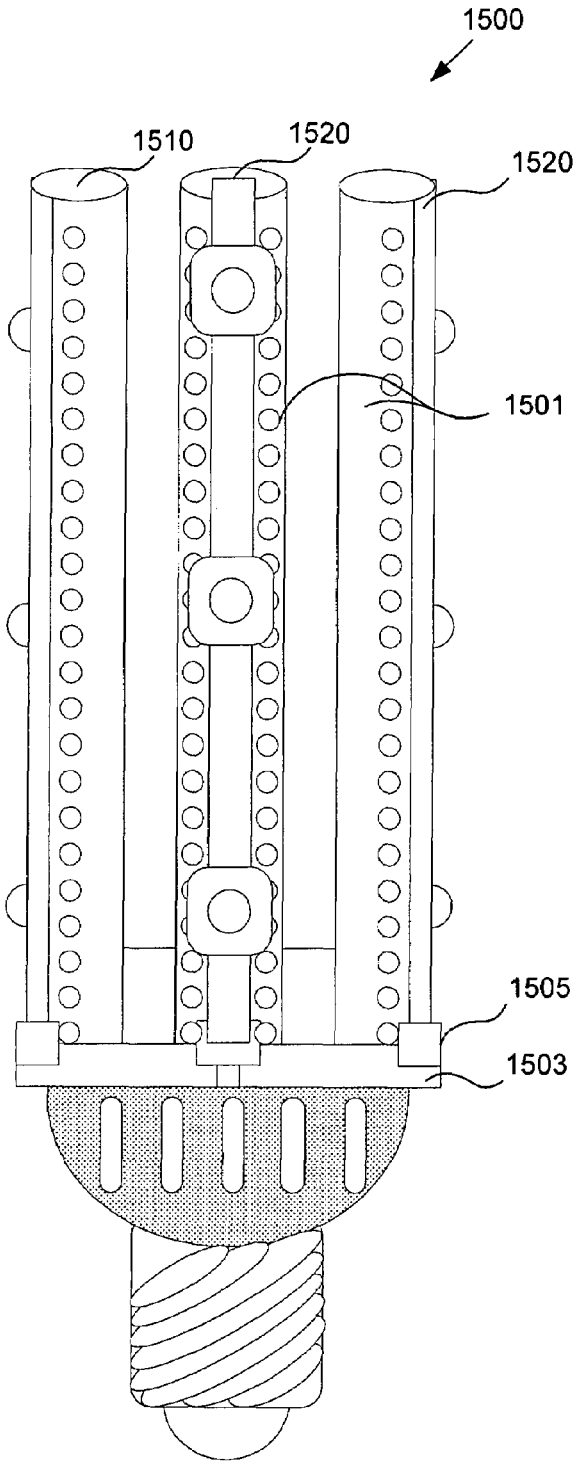
FIG. 15A is a diagrammatic representation of a lighting device with multiple frames according to various embodiments of the present invention.
Figure 15B:
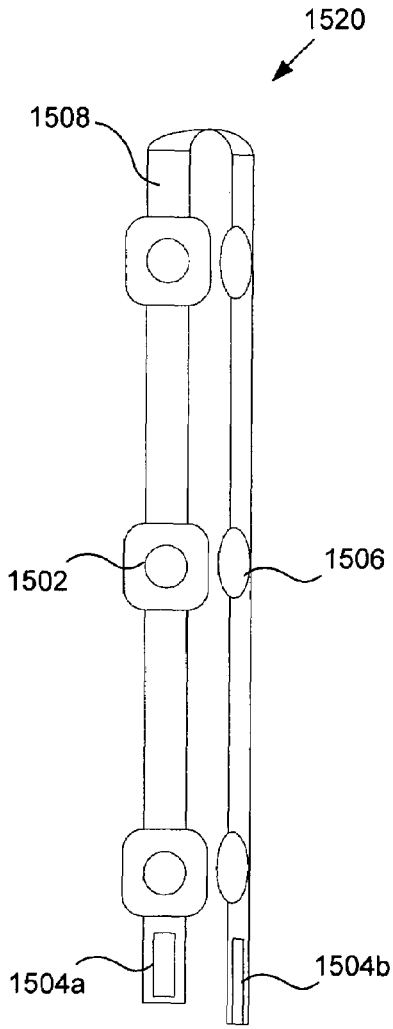
FIG. 15B is a diagrammatic representation of a modular LED subassembly for mounting onto the lighting device in FIG. 15A.

FIG. 15A is a diagrammatic representation of a lighting device 1500 with multiple frames 1501 (or frame components) according to various embodiments of the present invention whereas FIG. 15B is a diagrammatic representation of a modular LED subassembly 1520 for mounting onto the lighting device in FIG. 15A. Subassembly 1520 can be constructed with any material, such as ⅛" thick aluminum backed circuit board 1508, for receiving surface mount LEDs 1502 or pre-packaged LEDs (on a small circuit board). Subassembly 1520 connects LEDs 1502 either in series or parallel. Snug points 1506 are configured to hold subassembly 1520 firmly to frame 1501 for good thermal transfer. Subassembly 1520 slides snugly in through the top opening 1510 of the frame 1501 (e.g., pipe) like a hairpin. The positive connector 1504*b* is generally longer than the negative connector 1504*a* and configured to slide into a corresponding receptacle 1505 in chassis 1503 from inside frame 1501. The negative connector slides in after the positive connector and is configured to slide into a corresponding receptacle 1505 in chassis 1503 from outside frame 1501.

Chassis 1503 has multiple mounts for inserting multiple frames 1501. Chassis 1503 is configured to resolve parallel and serial connections between multiple subassemblies 1520. For example, 2 subassemblies 1520, of 3 LEDs in series, are connected and construct a 6 LED leg. A second series of 6 LEDs is constructed using 2 more subassemblies 1520 and creates 2 legs of 6 LEDs for a total of 12 LEDs in a 2 by 6 arrangement.

Frames 1501 can individually or collectively have more than one subassembly 1520. However, a single subassembly 1520 on each frame creates better cooling than multiple subassemblies on a single frame because the LEDs are competing less for surface area to dissipate their heat. Frames 1501 can be configured to be detachable for easy removal from chassis 1503. On the other hand, frames 1501 can be configured to be fixedly coupled to chassis 1503. In one embodiment, frames 1501 include modular frames laterally positioned (see FIG. 15A) around chassis 1503.

Figure 16:
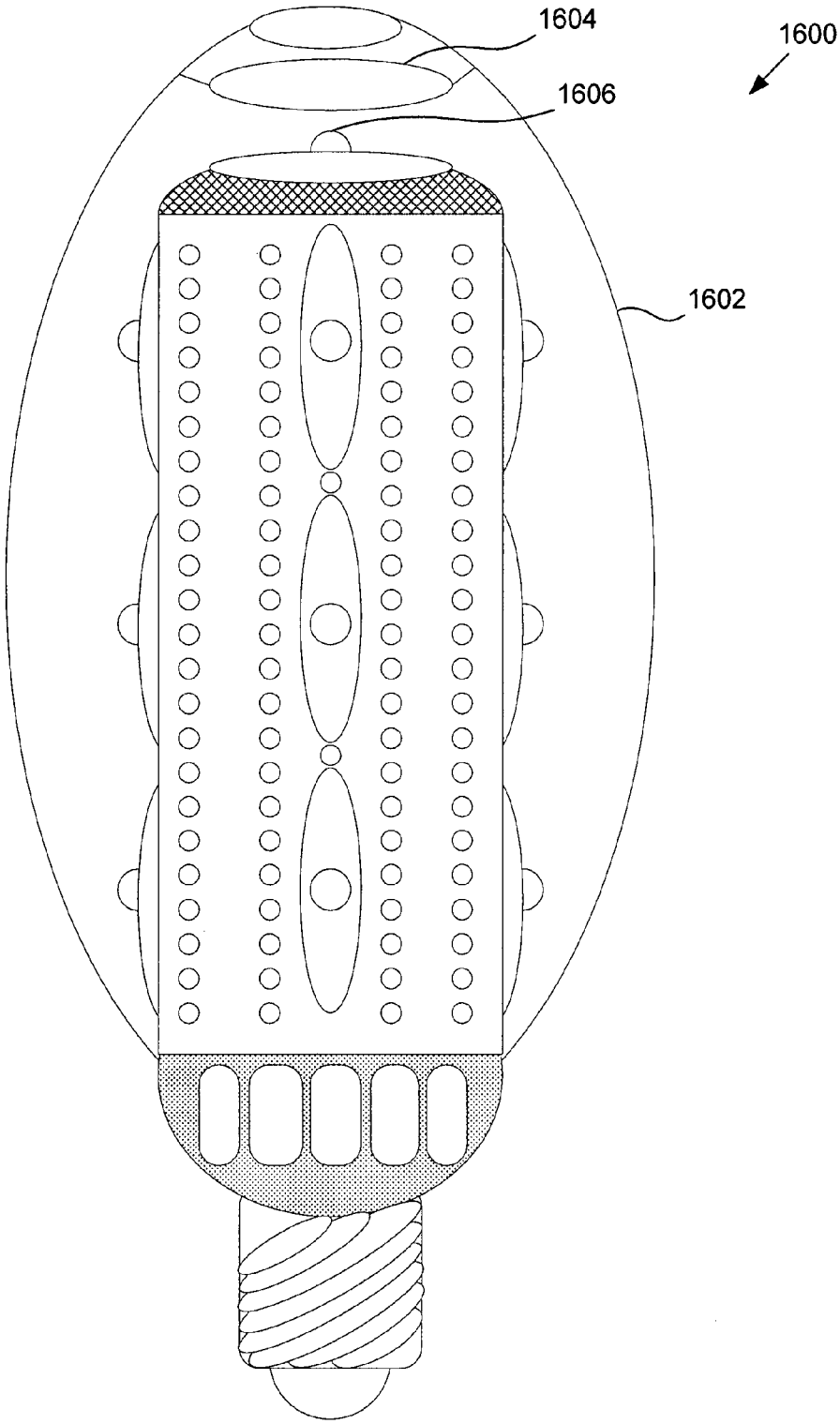
FIG. 16 is a diagrammatic representation of a lighting device with a light diffusing cover.

FIG. 16 is a diagrammatic representation of a lighting device 1600 with a light diffusing cover 1602. Cover 1602 may be constructed with a shatter resistant material, such as polymers from PollyBrite® and Westinghouse®, to maintain ruggedness of the LEDs. Cover 1602 can be employed as a light diffuser. An optional inner diffuser disk 1604 can be used with an optional top mounted LED 1606. Inner diffuser disk 1604 should not restrict ventilation within cover 1602. According to various embodiments, larger and/or more ventilation holes can be implemented throughout the frame or chassis.

Figure 17:
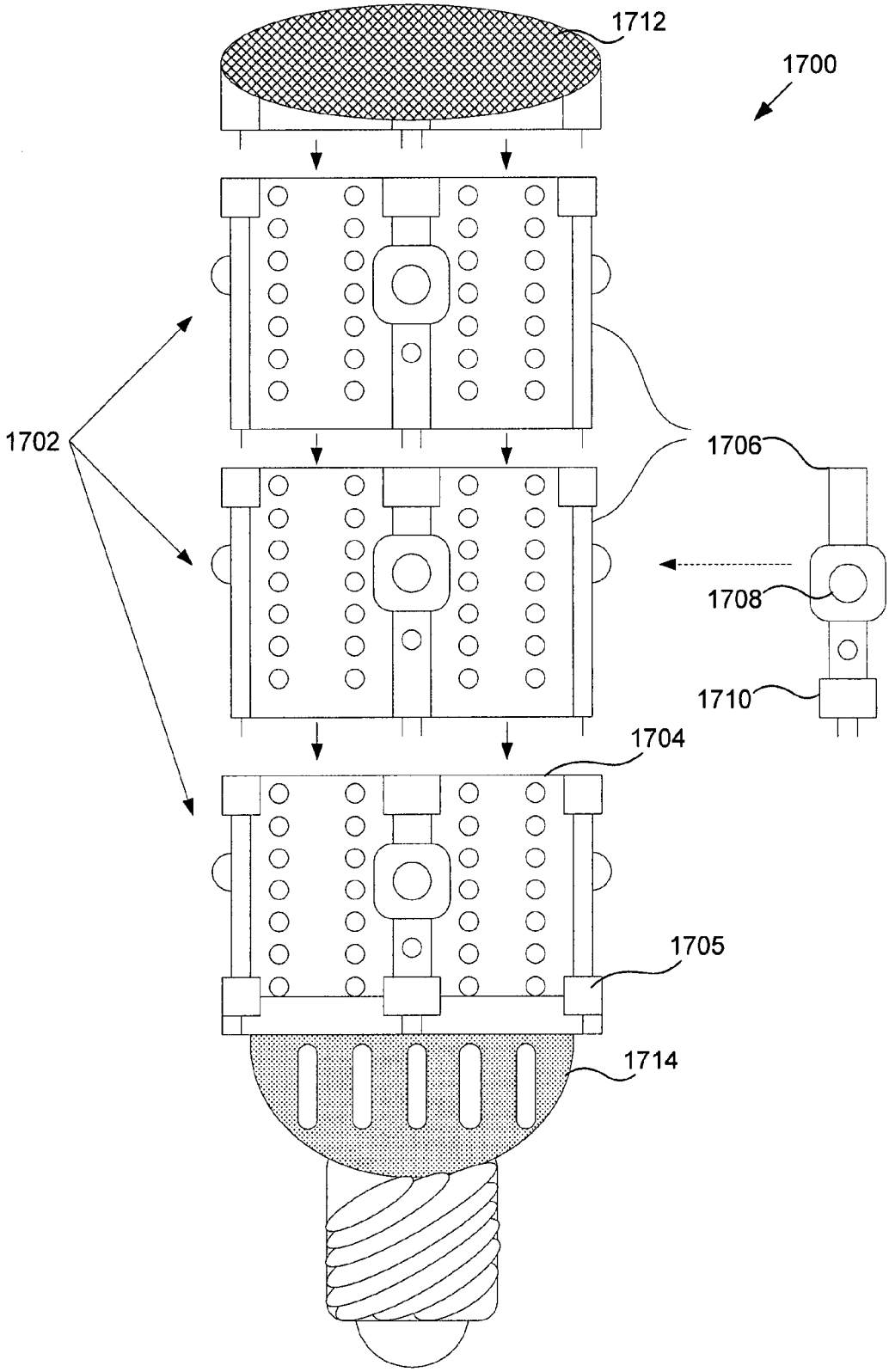
FIG. 17 is a diagrammatic representation of a lighting device with stacked modules according to various embodiments of the present invention.

FIG. 17 is a diagrammatic representation of a lighting device 1700 with stacked modules 1702 according to various embodiments of the present invention. Lighting device 1700 constructed as an expandable lighting device. A lighting device with four 50 lumen LEDs and totaling 200 lumens can be doubled by adding another module 1702. Lighting device 1700 can be modified from cool white to warm white lighting. A cool white lighting device can be intensified and softened by inserting a module 1702 with constructed with warm white LEDs.

Module 1702 (modular stacked frame) includes a frame 1704 for receiving LEDs, such as subassembly 1706. Subassembly 1706 can be an approximately ⅛" thick aluminum backed circuit board with surface mount LEDs 1708 or pre-packaged LEDs (on a small circuit board). Positive and negative connector leads 1710 plug into corresponding receptacles 1705 located on the exposed edge (outside of the frame) or hidden edge (inside of the frame) of an adjacent module 1702 or chassis 1714.

The stack modules have LEDs mounted around the frame 1704 (e.g., pipe). One module mounts to the next where metal connector pins can be used to connect the circuit between modules. Stack modules connect LEDs either in series or parallel. A variety of mounting techniques can be implemented as long as the modules are secured and/or electrical connections are maintained between modules and LEDs.

Alternately, an automobile light bulb type of construction could be realized where the modules are stacked/mounted using a push and turn technique.

A pipe or tube frame is shown in FIG. 17. The diameter of the pipe or tube can vary. A module cross section can be single-sided or multi-sided. It can be oval shaped, but is not necessarily hollow. The material used in constructing the frame module is normally metal. However, other materials can be used. The material should have low thermal resistance.

Module 1702 can have several LEDs around the pipe or one or more LEDs concentrated in a single area. As such, lighting device 1700 can be constructed with light projecting in one or multiple directions. A spot or flood lamp can be realized by constructing a module with no LEDs and mounting a single LED on a cap 1712.

Cap 1712 can have LEDs (not shown) and/or ventilation holes or a grill (grill shown) on top. The cap has pins for mounting to a stack module. The cap pins can complete the circuit or be electrically neutral. Ventilation holes and slots can also be included in the frame and chassis. The chassis can contain a constant current AC to DC driver to provide additional power when another stack module is added. However, each stack module could have its own driver which taps into the main power line when assembled. A screw in chassis is shown but almost any chassis is possible, including push and turn, pinned or double ended and pinned such as those found on conventional fluorescent tubes.

One of the many advantages of the present invention is that manufacturing is simplified when the repetitive module design approach is taken into account. Versatility is enhanced if LEDs are inserted into mounts located on the modules. Any color or intensity LED can be inserted in a mount as long as the electrical characteristics are unchanged. Jumpers can be inserted in mounts when they are not used. A defective chassis can also be easily replaced. Lighting device 1700 can be enhanced by including a "smart" chassis (e.g., including a smart strip 1410). The smart chassis can add dimming, smart heat management, wireless remote control, and could include multi-bulb light intensity management. A replacement chassis can be configured with a LED driver that provides more power so additional LED modules can be inserted/added.

Figure 18A:
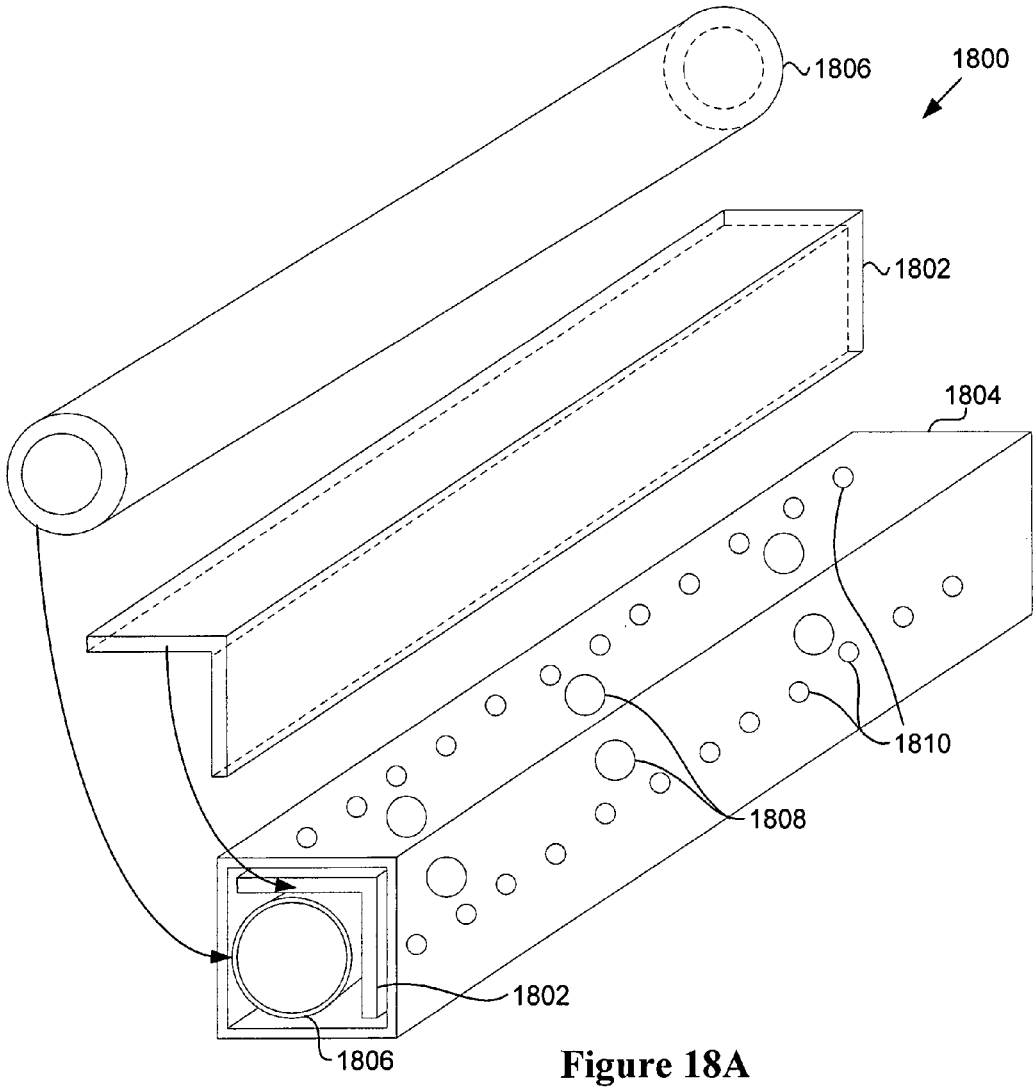
FIG. 18A is a diagrammatic representation of a lighting device manufacturing assembly according to a first embodiment of the present invention.

Various mechanisms and techniques can be used to fabricate the lighting devices of the present invention. Some mechanisms may be implemented to facilitate handling of lighting device components and/or preparing them for incorporation into the lighting devices. In some cases, mechanisms are configured to securely handle lighting device components while preparing them for integration with other lighting device components. For example, FIG. 18A is a diagrammatic representation of a lighting device manufacturing assembly 1800 according to a first embodiment of the present invention. In general, lighting device manufacturing assembly 1800 is configured to prepare a frame of the lighting device.

Manufacturing assembly 1800 includes guides 1802 and 1804. Any mechanism for securely handling a frame is referred to herein as a guide. In this embodiment, guides 1802 and 1804 are drill guides for precision drilling of holes into a frame 1806 (e.g., ½" and 1½" pipe). The drilled holes are for LED mounting and ventilation according to the present invention. In this specific embodiment, frame 1806 is a ½" aluminum conduit, guide 1802 is a ⅛".times.¾".times.¾".times.4' angle gauge, and guide 1804 is a ⅛".times.1".times.4' square tube. As shown, holes 1808 (e.g., #10 holes) penetrate the square tube only whereas holes 1810 (e.g., 7⁄64" holes) penetrate the square tube, angle gauge and conduit. It will be appreciated by those of skill in the art that the dimensions, materials, etc., recited in this embodiment are purely illustrative.

Similarly, some techniques may be used to facilitate handling of lighting device components and/or preparing them for incorporation into the light devices.

For example, the following method operations can be used to drill a frame:

1) Drill and thread #10 holes on 2 adjacent sides of the 1" square tube.

2) Insert angle gauge into 1" tube such that the sides are seen through the #10 holes.

3) Insert ½" conduit into the 1" square tube.

4) Hold the conduit in place by tightening the #10 screws, which apply pressure to the angle gauge against the conduit.

5) Drill 7⁄64" holes spaced ½" apart along all 4 sides of the square tube and insure the holes penetrate the conduit. Disperse the holes around the pipe such that a fifth line of holes can be drilled later.

6) Loosen the #10 screws and rotate the conduit in a manner as to be able to drill a fifth line of holes along the conduit. Tighten the #10 screw such that the angle gauge clamps down and holds the conduit snugly in place.

7) Use the holes in the square tube and the angle gauge as guides to drill the fifth line of holes along the pipe.

8) Rotate the conduit and repeat step 7 to drill as may ventilation holes as required or to prepare as many lighting device frames as needed.

The lighting devices can be built by cutting the drilled frame (e.g., conduit) to size. Determine the location of the LEDs along the conduit. Before mounting the LEDS to the conduit, the ventilation holes can be enlarged on each side of the LED mounting points. Mount the LEDS along the conduit using sheet metal screws and the mounting holes between each enlarged vent hole. Solder 20 gauge single conductor wire to the LED solder pads and feed the wire through the conduit using the enlarge ventilation holes. Attach the opposite ends of the wire leads to the next LED to ensure the wiring is in series or parallel as pre-determined by the LED driver wiring diagram. Mount the frame to a chassis or fixture and complete the wiring.

Figure 18B:
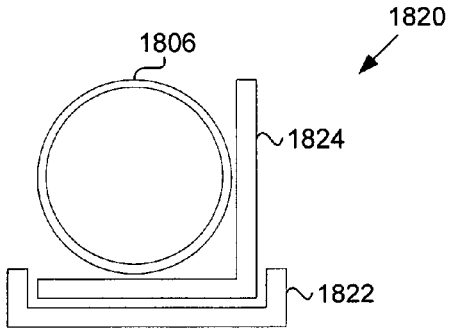
FIG. 18B is a diagrammatic representation of a light device manufacturing assembly according to a second embodiment of the present invention.

FIG. 18B is a diagrammatic representation of a light device manufacturing assembly 1820 according to a second embodiment of the present invention. This specific embodiment is applicable to lighting devices with a large diameter frame and/or when square tubing is difficult to find. In this specific embodiment, drill guides 1822 (i.e., C-channel) and 1824 (i.e., angle gauge) are used. The follow method operations can be performed to drill a frame:

1) Apply C-clamps to hold the frame (e.g., tubing), angle gauge and C-channel securely in place.

2) Drill the guide holes through the C-channel and both sides of the angle gauge and tube.

3) Rotate the tube and use the guide holes to drill as many holes in the tubing as required to provide adequate mount and ventilation holes.

To enhance manufacturing where pre-drilled tubing or punched and formed sheet metal tubing is not available, a drill guide can be constructed to prepare large sections of tubing. When drilling is complete, the tubing is cut into sections so several LED frames/lamps can be constructed from one tube.

An advantage of the present invention is that commonly available reclaimed materials may be used for many of the lighting device components. For example, in some embodiments of the invention, the frame for the lighting devices can be made from conventional/reclaimed piping material. For another example, in some embodiments, the chassis can be made from portions of a conventional incandescent light bulb. It should be noted that various portions of lighting devices 100, 200, 1200, 1300, 1400, 1500, 1600, and 1700 could be similar. In some implementations, these portions are interchangeable.

While the invention has been particularly shown and described with reference to specific embodiments thereof, it will be understood by those skilled in the art that changes in the form and details of the disclosed embodiments may be made without departing from the spirit or scope of the invention. For example, ventilation holes may be integrated into any suitable portion of the lighting device, including the cap. For another example, a 4' fluorescent tube bulb can be replaced with an LED bulb of the present invention. The ballast of a fluorescent fixture could be used as well if a surge protector/power converter is integrated (e.g., inside the frame or chassis) with the LED bulb. Moreover, the particular dimensions, materials, component brands, etc. recited above are merely illustrative. The fabrication methods described herein may also be partially or fully automated. Therefore, the scope of the invention should be determined with reference to the appended claims.

What is claimed is:

1. A lighting device, comprising:

a plurality of modular subassembly, each modular subassembly comprising an outer surface and at least one lighting element on the outer surface;

a metal frame formed of sheet metal, having at least one surface substantially parallel to a long axis, the metal frame configured to receive the plurality of modular subassemblies, and the metal frame configured to conduct heat from the lighting elements, wherein each outer surface of the modular subassemblies is substantially parallel to the long axis; and electrical circuitry for providing electricity to the lighting elements, wherein each modular subassembly includes snug points for attaching the modular subassembly to the metal frame.

2. A lighting device, comprising:

a plurality of modular subassembly, each modular subassembly comprising an outer surface and at least one lighting element on the outer surface;

a metal frame formed of sheet metal, having at least one surface substantially parallel to a long axis, the metal frame configured to receive the plurality of modular subassemblies, and the metal frame configured to conduct heat from the lighting elements, wherein each outer surface of the modular subassemblies is substantially parallel to the long axis; and electrical circuitry for providing electricity to the lighting elements, wherein the metal frame includes a plurality of mounts and wherein each mount is configured to receive a modular subassembly and wherein the metal frame further comprises a plurality of metal frame components, each frame component being configured for a corresponding plurality of modular subassemblies and further configured to connect to another frame component.

3. A lighting device, comprising:

a plurality of modular subassembly, each modular subassembly comprising an outer surface and at least one lighting element on the outer surface;

a metal frame formed of sheet metal, having at least one surface substantially parallel to a long axis, the metal frame configured to receive the plurality of modular subassemblies, and the metal frame configured to conduct heat from the lighting elements, wherein each outer surface of the modular subassemblies is substantially parallel to the long axis; and electrical circuitry for providing electricity to the lighting elements, wherein the metal frame comprises multiple ventilation holes from an outer surface to an inner surface, the outer surface being configured for receiving the plurality of lighting elements.

4. The lighting device of claim 3, wherein each modular subassembly includes snug points for attaching the modular subassembly to the metal frame and wherein each modular subassembly is configured to slip over an edge of the metal frame such that the snug points press against the metal frame.

5. The lighting device of claim 3, wherein the metal frame further comprises:

a plurality of mounts, each mount configured to receive a modular subassembly; and a plurality of metal frame components, each frame component being configured for a corresponding plurality of modular subassemblies and further configured to connect to another frame component and further configured with metal connector pins enabling the modular subassemblies on connected frame components to electrically connect.

6. A lighting device, comprising:

a plurality of modular subassembly, each modular subassembly comprising an outer surface and at least one lighting element on the outer surface;

a metal frame formed of sheet metal, having at least one surface substantially parallel to a long axis, the metal frame configured to receive the plurality of modular subassemblies, and the metal frame configured to conduct heat from the lighting elements, wherein each outer surface of the modular subassemblies is substantially parallel to the long axis;

electrical circuitry for providing electricity to the lighting elements; and a smart strip configured to implement smart features with the lighting device, the smart features being selected from the group consisting of detecting ambient light conditions, detecting motion, and communicating with a controller.

7. A method of fabricating a lighting device, the method comprising:

providing a plurality of modular subassemblies having a plurality of light emitting diodes (LEDs);

forming a metal frame from sheet metal;

configuring the metal frame to receive the plurality of modular subassemblies;

providing a chassis configured to receive the metal frame, the chassis being further configured to receive the plurality of modular subassemblies and further configured to be received by an electrical socket;

attaching the chassis to the metal frame;

attaching the plurality of modular subassemblies to the chassis; and attaching the plurality of modular subassemblies to the metal frame.

8. The method of claim 7, wherein the forming step further comprises creating ventilation holes in the metal frame.

9. The method of claim 7, wherein the forming step further comprises adding mounting holes to the metal frame for attaching the plurality of modular subassemblies.

10. The method of claim 7, wherein the step of forming the metal frame comprises forming a plurality of frame components, each frame component being configured for a corresponding plurality of modular subassemblies and further configured to receive another frame component.

11. A lighting device, comprising:

a plurality of modular subassemblies having a plurality of lighting elements;

a metal frame configured to receive the plurality of modular subassemblies and further configured to conduct heat from the plurality of lighting elements;

electrical circuitry for providing electricity to the plurality of lighting elements; and a chassis having a first end configured to receive the metal frame and a second end configured to be electrically and mechanically coupled with a screw-type incandescent lighting fixture.

12. The lighting device of claim 11, wherein the metal frame further comprises a cylinder with two opposite end openings and the lighting device further comprises a cap configured to cover one of the end openings, the cap having an integrated fan for drawing air from inside the pipe to outside the pipe.

13. The lighting device of claim 11, wherein each modular subassembly further comprises a fold dividing each subassembly into a first portion configured to receive the plurality of lighting elements and a second portion configured to slide into the metal frame.

14. The lighting device of claim 11, wherein each modular subassembly includes snug points for attaching the modular subassembly to the metal frame and wherein each modular subassembly is configured to slip over an edge of the metal frame such that the snug points press against the metal frame.

15. The lighting device of claim 11, wherein the metal frame further comprises:

a plurality of mounts, each mount configured to receive a modular subassembly; and a plurality of metal frame components, each frame component being configured for a corresponding plurality of modular subassemblies and further configured to connect to another frame component and further configured with metal connector pins enabling the modular subassemblies on connected frame components to electrically connect.

16. The lighting device of claim 11, wherein the metal frame is formed of sheet metal.

17. A lighting device, comprising:

a plurality of modular subassembly, each modular subassembly comprising an outer surface and at least one lighting element on the outer surface;

a metal frame formed of sheet metal, having at least one surface substantially parallel to a long axis, the metal frame configured to receive the plurality of modular subassemblies, and the metal frame configured to conduct heat from the lighting elements, wherein each outer surface of the modular subassemblies is substantially parallel to the long axis;

electrical circuitry for providing electricity to the lighting elements; and a chassis configured to receive the metal frame and configured to be received by a socket of a fluorescent lighting fixture.

18. The lighting device of claim 17, wherein each modular subassembly includes snug points for attaching the modular subassembly to the metal frame and wherein each modular subassembly is configured to slip over an edge of the metal frame such that the snug points press against the metal frame.

19. The lighting device of claim 17, wherein the metal frame further comprises:

a plurality of mounts, each mount configured to receive a modular subassembly; and a plurality of metal frame components, each frame component being configured for a corresponding plurality of modular subassemblies and further configured to connect to another frame component and further configured with metal connector pins enabling the modular subassemblies on connected frame components to electrically connect.

20. The lighting device of claim 17, wherein the metal frame further comprises a plurality of cylinders.

* * * * *